US010899596B2

(12) United States Patent
Renzi

(10) Patent No.: US 10,899,596 B2
(45) Date of Patent: Jan. 26, 2021

(54) DISPENSER FOR GAS-CONTAINING BEVERAGES, DISPENSING METHOD AND COMPUTER PROGRAM

(71) Applicant: O.D.L. S.R.L., Lierna (IT)

(72) Inventor: Massimiliano Renzi, Lierna (IT)

(73) Assignee: O.D.L. S.R.L., Lierna (IT)

( * ) Notice: Subject to any disclaimer, the term of this patent is extended or adjusted under 35 U.S.C. 154(b) by 0 days.

(21) Appl. No.: 16/091,465

(22) PCT Filed: Apr. 7, 2017

(86) PCT No.: PCT/IB2017/052011
§ 371 (c)(1),
(2) Date: Oct. 4, 2018

(87) PCT Pub. No.: WO2017/175188
PCT Pub. Date: Oct. 12, 2017

(65) Prior Publication Data

US 2019/0152759 A1 May 23, 2019

(30) Foreign Application Priority Data

Apr. 7, 2016 (IT) ..... 102016000035922
Apr. 7, 2016 (IT) ..... 102016000035927
(Continued)

(51) Int. Cl.
*B67D 1/04* (2006.01)
*B67D 1/08* (2006.01)
*B67D 1/12* (2006.01)

(52) U.S. Cl.
CPC ..... *B67D 1/0888* (2013.01); *B67D 1/0406* (2013.01); *B67D 1/0884* (2013.01);
(Continued)

(58) Field of Classification Search
CPC .. B67D 1/0888; B67D 1/0884; B67D 1/0406; B67D 1/1252; B67D 1/04; B67D 1/08; B67D 1/12
See application file for complete search history.

(56) References Cited

U.S. PATENT DOCUMENTS 3,876,107 A * 4/1975 Meindl ..... B67D 1/0009 222/64
4,869,396 A * 9/1989 Horino ..... B67D 1/06 222/54
(Continued)

FOREIGN PATENT DOCUMENTS

FR 2 659 314 A1 9/1991
GB 2 454 904 A 5/2009
(Continued)

OTHER PUBLICATIONS

International Search Report and Written Opinion for International Application No. PCT/IB2017/052011, dated Nov. 16, 2017.
(Continued)

*Primary Examiner* — Frederick C Nicolas
(74) *Attorney, Agent, or Firm* — Wolf, Greenfield & Sacks, P.C.

(57) ABSTRACT

A device for on-site dispensing of a beverage containing a liquid and a gaseous substance dissolved therein is described. The device includes a dispenser, and a conduit for supplying the beverage to the dispenser. The conduit is configured to be connected to a container suitable for containing at least liquid for obtaining the beverage. The device further includes a pusher for imparting to the beverage a push sufficient to enable the dispensing of the beverage via the dispenser according to a predetermined dispensing condition. Furthermore, the device can include a pressure modulator for modulating the pressure in the conduit, a pressure reducer to be introduced into the container, and a
(Continued)

compensator for improving the operation of the device on the basis of one or more automatic controls thereof.

25 Claims, 19 Drawing Sheets

(30) Foreign Application Priority Data

Apr. 7, 2016 (IT) ..... 102016000035931
Apr. 7, 2016 (IT) ..... 102016000035938

(52) U.S. Cl.
CPC ..... *B67D 1/1252* (2013.01); *B67D 1/04* (2013.01); *B67D 1/08* (2013.01); *B67D 1/12* (2013.01)

(56) References Cited

U.S. PATENT DOCUMENTS 5,303,845 A * 4/1994 Osawa ..... B67D 1/1252 222/1
5,335,705 A * 8/1994 Morishita ..... B67D 1/04 141/104
5,568,882 A * 10/1996 Takacs ..... G01F 23/168 222/155
5,871,121 A * 2/1999 Hashimoto ..... B67D 1/1252 222/54
5,988,859 A * 11/1999 Kirk ..... B67D 1/06 222/30
6,170,703 B1 * 1/2001 Butler ..... B67D 1/0045 222/1
6,237,652 B1 * 5/2001 Nelson ..... B67C 3/2608 141/18
6,347,641 B2 * 2/2002 Guarneri ..... B01J 4/008 137/209
6,460,730 B1 * 10/2002 Liedtke ..... B05B 9/04 222/1
2003/0080142 A1 5/2003 Meheen
2016/0130127 A1 * 5/2016 Copenhaver ..... B67D 1/0037 222/129.3

FOREIGN PATENT DOCUMENTS

WO WO 02/33270 A2 4/2004
WO WO 2015/015275 A1 2/2015

OTHER PUBLICATIONS

International Preliminary Report on Patentability for International Application No. PCT/IB2017/052011, dated Oct. 18, 2018.

* cited by examiner

DISPENSER FOR GAS-CONTAINING BEVERAGES, DISPENSING METHOD AND COMPUTER PROGRAM

RELATED APPLICATIONS

This application is a national stage filing under 35 U.S.C. § 371 of International Application Number PCT/IB2017/052011, filed on Apr. 7, 2017, and claims the benefit of Italian application number IT/102016000035922, filed Apr. 7, 2016, IT/102016000035927, filed Apr. 7, 2016, IT/102016000035931, filed Apr. 7, 2016 and IT/102016000035938, filed Apr. 7, 2016, each of which is herein incorporated by reference in its entirety.

TECHNICAL FIELD

The present application relates to the dispensing of beverages, and more in particular to devices for on-site dispensing of beverages, methods for on-site dispensing of beverages and computer programs for enabling the on-site dispensing of beverages.

BACKGROUND OF THE INVENTION

Systems for the on-site dispensing of gas-containing beverages are well known, as illustrated, for example, in FIG. 1. The component liquid of such a beverage is typically contained in a container 1, such as, for example, a keg made of any material suited to this purpose. Gas can be already dissolved in the liquid. A cylinder 2 containing the gas is moreover typically provided; it is usually, but not necessarily, of the same type as that dissolved in the liquid. A pressure reducer 3, connected to the cylinder 2, makes it possible to partialize the outlet pressure of the cylinder 2 and introduce the gas at this pressure (possibly partialized) into the container 1. The gas thus introduced provides the liquid (i.e. the beverage) with the push necessary to enable the dispensing thereof from the tap 6. The gas introduced into the keg 1 can render the liquid effervescent, or can be added to the gas already dissolved in the liquid present in the keg 1. The system in FIG. 1 further comprises a conduit which conveys the beverage from the keg 1 to the tap 6. Optionally, the conduit can be provided with a chiller 4", i.e. a system capable of chilling the beverage, and an insulating refrigerating system to prevent the conduit from being in contact with the temperature outside the system. Furthermore, the system can comprise a pressure and flow compensator 7, which enables a calibration of the flow in the conduit and consequently a calibration of the pressure of the liquid in the conduit during dispensing, all in order to ensure that dispensing takes place under the best possible conditions. Calibration of the system by means of the compensator 7 and/or reducer 3 is performed infrequently, for example once in winter and once in summer. The lever for setting the compensator 7 is typically adjusted by an expert so as to facilitate dispensing in some transitional conditions; an incorrect or accidental actuation thereof can compromise the dispensing conditions, thus destabilizing the dispensing system. In addition, the adjustments of the reducer and compensator are made considering the standard thermal conditions for the environment and assuming that the keg is always in a thermal equilibrium with the environment. For this reason, during dispensing the known dispensing system can produce foam beyond acceptable or desirable limits, at least in some circumstances and under particular thermal conditions (for example, keg not in equilibrium with the environment). Furthermore, such a system involves a waste of gas, as the reducer has to be set on pressure values that give a margin of safety with respect to the foam phenomenon.

Document U.S. Pat. No. 4,569,396 introduces a dispensing system in which the temperature of the beverage in the keg is measured and the reducer is adjusted based thereupon in order to obtain more adequate dispensing. However, even such a system can at times induce undesirable foam during dispensing. Furthermore, the known dispensing devices often entail a pointless waste of gas.

SUMMARY OF THE INVENTION

The present invention has the object of obviating the problems tied to the known techniques for dispensing beverages containing a liquid and a gaseous substance dissolved therein, and of providing better dispensing than is obtainable by means of known techniques, at least in certain specific circumstances.

The various aspects of the invention can be schematically described as follows:

A1. A device (90) for on-site dispensing of a beverage containing a liquid and a gaseous substance dissolved therein, the device comprising:

a dispensing means (60) for dispensing the beverage;

a conduit (40) for supplying the beverage to said dispensing means (60), wherein said conduit (40) is configured to be connected to a container (10) suitable for containing at least liquid for obtaining said beverage;

a pushing means (20, 20') for imparting to said beverage a push sufficient to enable the dispensing of the beverage via said dispensing means (60) according to a predetermined dispensing condition;

a pressure modulating means (30) suitable for modulating the pressure of the beverage in said conduit (40), wherein said pressure modulating means (30) is capable of modulating the pressure of the beverage even when the beverage flow is zero due to the effect of the dispensing means (60);

a control means (70) configured to control the activation of the modulating means (30) in such a way that the modulating means modulate the pressure in said conduit upon the occurrence of a predetermined condition.

A2. The device (90) according to aspect A1, wherein the occurrence of a predetermined condition comprises the occurrence of at least one between:

a pressure value detected by a pressure sensor disposed along the conduit (40) becomes equal to or less than a predetermined value; and the activation of said modulating means (30) has reached a maximum pre-established activation value.

A3. The device (90) according to aspect A1 or A2, wherein controlling the activation of the modulating means (30) comprises forcing at least some of the component liquid of said beverage into said conduit (40) by means of said modulating means (30).

A4. The device (90) according to any one of the preceding aspects A1-A3, wherein the pressure modulating means (30) is configured to decrease the pressure in the conduit (40).

A5. The device (90) according to any one of the preceding aspects A1-A4, wherein the pushing means (20) comprises at least one between:

an introduction means configured to introduce said gaseous substance in said container (10) at a pressure such as to provide said push, and a pumping means (20'), disposed downstream of the container, so as to pump said liquid.

A6. The device (90) according to any one of the preceding aspects A1-A5, wherein said pressure modulating means (30) is capable of adjusting the pressure of the beverage in said conduit (40) between a plurality of non-zero values even when the beverage flow is zero.

A7. The device (90) according to any one of the preceding aspects A1-A6, wherein the control means (70) is configured to control the activation of said modulating means (30) when the dispensing means (60) is in a status in which there is no dispensing of the beverage.

A8. The device (90) according to any one of the preceding aspects A1-A7, comprising a check valve disposed upstream of the modulating means (30) and a check valve downstream of the container (10).

A9. The device (90) according to any one of the preceding aspects A1-A8, wherein the modulating means (30) comprises a piston suitable for delivering at least some of the component liquid of said beverage into said conduit, said piston thus allowing the pressure of the beverage in said conduit (40) to be adjusted.

A10. The device (90) according to any one of the preceding aspects A1-A9, wherein the occurrence of a predetermined condition comprises detecting that the modulating means (30) is not capable of increasing the pressure up to a predetermined value, and upon the occurrence of that condition the control means is configured to control the pushing means in such a way as to cause an increase in the pushing pressure.

A11. A method for controlling a device (90) for on-site dispensing of a beverage containing a liquid and a gaseous substance dissolved therein, said device (90) comprising a dispensing means (60) for dispensing the beverage, the method comprising:

supplying (S10) the beverage to said dispensing means (60) by means of a conduit (40);

causing (S20) a push to be imparted to said beverage, said push being sufficient to enable the dispensing of the beverage via said dispensing means (60) according to a predetermined dispensing condition;

modulating (S30) the pressure in said conduit (40) upon the occurrence of a predetermined condition.

A12. The method according to aspect A11, wherein the modulating (S30) the pressure in said conduit (40) comprises forcing at least some of a component liquid of said beverage into said conduit (40).

A13. The method according to aspect A11 or A12, wherein modulating (S30) the pressure in said conduit (40) comprises activating a piston, said piston being suitable for delivering some of a component liquid of said beverage into said conduit, said piston thus allowing the pressure of the beverage in said conduit (40) to be modulated.

A14. A computer program comprising instructions that are suitable for executing the steps of aspects A11 to A13 when the program is run on a computer.

A15. A system for on-site dispensing of a beverage containing a liquid and a gaseous substance dissolved therein, the system comprising a container (10) suitable for containing said beverage and a device (90) according to any one of the preceding aspects A1 to A10.

B1. The device (92) for on-site dispensing of a beverage containing a liquid and a gaseous substance dissolved therein, the device comprising:

a dispensing means (60) for dispensing the beverage;

a conduit (40) for supplying the beverage to said dispensing means (60), wherein said conduit (40) is configured to be connected to a container (10) suitable for containing at least liquid for obtaining said beverage;

a means for indicating the presence of foam (32) in order to provide an indication of the presence of foam in said conduit (40);

a partialization means (22) configured to introduce said gaseous substance into the container at a partialization pressure (P22);

a control means (72) for determining a desired pressure in the container (P10) on the basis of said indication of the presence of foam, wherein the control means (72) is configured to set the partialization pressure (P22) on the basis of at least one among the desired pressure in the container (P10), a dispensing status of the dispensing means (60), and an indication of a variation in the presence of foam in the conduit.

B2. The device according to aspect B1, wherein the control means (72) is configured to determine a desired pressure in the container (P10) on the basis of at least one among: the temperature of the beverage in the container (10), type of beverage contained in the container (10) and said indication of the presence of foam.

B3. The device according to aspect B1 or B2, wherein the control means (72) is configured to set the partialization pressure on the basis of the desired pressure in the container (P10) and an indication of a variation in the presence of foam in the conduit (40).

B4. The device according to one of the preceding aspects B1-B3, wherein the desired pressure in the container (P10) is a value comprised between a saturation pressure value of the beverage and a maximum pressure value, wherein the saturation value of the beverage is the one corresponding to a state of saturation of the gas in the liquid at a temperature inside the container, and the maximum pressure value is the one corresponding to a maximum preset value, preferably at the temperature inside the container.

B5. The device (92) according to one of the preceding claims, wherein the indication of the presence of foam comprises an activation value of a system for variation of the pressure of the beverage in said conduit, the variation system being disposed along the conduit (40) and configured to deliver at least some of a component liquid of said beverage into said conduit (40).

B6. The device (92) according to one of the preceding aspects B1-B5, wherein the means for indicating the presence of foam (32) comprises a piston suitable for delivering at least some of a component liquid of said beverage into said conduit, and wherein the means for indicating the presence of foam (32) is configured to generate an indication of the presence of foam when at an activation value of the piston it is not possible to reach a predetermined pressure (P40) in the conduit.

B7. The device (92) according to aspect B6, wherein the activation value generated by the piston comprises a number of strokes carried out for each attempt to increase the pressure in the conduit.

B8. The device (92) according to aspect B6 or B7, wherein the means for indicating the presence of foam (32) is further configured to generate the indication of a variation in the presence of foam in the conduit on the basis of a plurality of activation values of the piston, said values corresponding to different attempts to increase the pressure in the conduit.

B9. The device according to one of the preceding aspects B1-B8, wherein the control means (72) is configured to set the partialization pressure (P22) on the basis of the desired pressure in the container (P10) when the indication of a variation in foam is positive, irrespective of the status of the dispensing means.

B10. The device according to one of the preceding aspects B1-B9, wherein setting the partialization pressure comprises at least one between:

decreasing the partialization pressure when the indication of a variation in foam is negative or zero, and/or the dispensing means is in a dispensing status, and/or the pressure in the container falls below the desired pressure;

increasing or restoring the partialization pressure when the indication of a variation in foam is positive, and/or the dispensing means is in a dispensing status, and the pressure in the container falls below the desired pressure.

B11. The device according to one of the preceding aspects B1-B10, wherein setting the partialization pressure comprises maintaining the partialization pressure (P22) unchanged when the indication of a variation in foam is negative or zero and the dispensing means is in a non-dispensing status.

B12. The method for controlling a device (92) for on-site dispensing of a beverage containing a liquid and a gaseous substance dissolved therein, said device (92) comprising a dispensing means (60) for dispensing the beverage, the method comprising:

supplying (S710) the beverage to said dispensing means (60) by means of a conduit (40);

providing an indication (S720) of the presence of foam in said conduit (40);

introducing (S730) said gaseous substance at a partialization pressure (P22) in a container (10) suitable for containing at least liquid necessary to obtain said beverage;

determining (S740) a desired pressure in the container (P10) on the basis of said indication of the presence of foam, setting (S750) the partialization pressure (P22) on the basis of at least one among the desired pressure in the container (P10), a dispensing status of the dispensing means (60), and an indication of a variation in the presence of foam in the conduit.

B13. The method according to aspect B12, wherein setting (S750) the partialization pressure (P22) comprises setting the partialization pressure on the basis of the desired pressure in the container (P10) and an indication of a variation in the presence of foam in the conduit (40).

B14. The computer program comprising instructions that are suitable for executing the steps of each of aspects B12 to B13 when the program is run on a computer.

B15. The system for on-site dispensing of a beverage containing a liquid and a gaseous substance dissolved therein, the system comprising a container (10) suitable for containing said beverage and a device (92) according to any one of aspects B1 to B11.

C1. The device (94) for on-site dispensing of a beverage containing a liquid and a gaseous substance dissolved therein, the device comprising:

a dispensing means (60) for dispensing the beverage;

a conduit (40) for supplying the beverage to said dispensing means (60), wherein said conduit (40) comprises a connection means (11) for connecting the conduit (40) to a container (10) suitable for containing at least liquid for obtaining said beverage;

a pressure compensating means (80) disposed along said conduit (40) and configured to vary the flow rate of the beverage so as to obtain a corresponding compensation pressure (P80);

a measuring means (82) configured to generate a temperature measurement and a pressure measurement of said beverage at said pressure compensating means (80);

a control means (74) configured to generate saturation information on the basis of a comparison between said pressure measurement and a saturation pressure of the beverage corresponding to said temperature measurement; and wherein the control means (74) is configured to determine a variation in the flow rate of the beverage on the basis of said saturation information, when the dispensing means is in a dispensing status, and wherein the pressure compensating means (80) is configured to apply said variation in the flow rate determined by the control means (74).

C2. The device according to aspect C1, wherein a variation in flow rate corresponds to an inverse variation in the compensation pressure at said compensation means.

C3. The device according to aspect C1 or C2, wherein determining a variation in the flow rate of the beverage comprises decreasing the flow rate of the beverage, thus obtaining an increase in the pressure of the beverage at the compensation means if said saturation information indicates that said pressure measurement is less than or equal to said saturation pressure, subject to the presence of a first threshold.

C4. The device according to aspect C1, C2, or C3, wherein determining a variation in the flow rate of the beverage comprises increasing the flow rate of the beverage, thus obtaining a decrease in the pressure of the beverage at the compensation means if said saturation information indicates that said pressure measurement is greater than or equal to said saturation pressure, subject to the presence of a higher threshold.

C5. The device according to any one of the preceding aspects C1-C4, wherein the control means (74) is configured to generate a warning signal if said saturation pressure information indicates that said pressure measurement is less than or equal to said saturation pressure, subject to the presence of a possible margin, and the applied flow rate is equal to the allowed minimum.

C6. The device according to any one of the preceding aspects C1-05, further comprising a pushing means (20, 20') for imparting to said beverage a push sufficient to enable the dispensing of the beverage via said dispensing means (60).

C7. The device according to aspect C5 or C6, wherein the control means (74) is configured to cause said pushing means to increase the push if said saturation pressure information indicates that said pressure measurement is less than or equal to said saturation pressure, subject to the presence of a possible margin, and the applied flow rate is equal to the allowed minimum.

C8. The method for controlling a device (92) for on-site dispensing of a beverage containing a liquid and a gaseous substance dissolved therein, said device (92) comprising a dispensing means (60) for dispensing the beverage, the method comprising the steps of:

supplying (S910) the beverage to said dispensing means (60) by means of a conduit (40);

generating (S920) a temperature measurement and a pressure measurement of said beverage at a pressure compensating means (80);

generating saturation information (S930) on the basis of a comparison between said pressure measurement and a saturation pressure of the beverage corresponding to said temperature measurement;

determining (S940) a variation in the flow rate of the beverage on the basis of said saturation information, when the dispensing means is in a dispensing status;

applying (S950), by means of said pressure compensating means (80), said variation in the flow rate determined in the step of determining (S940) a variation in the flow rate.

C9. The computer program comprising instructions that are suitable for executing the steps of aspect C8 when the program is run on a computer.

C10. The system for on-site dispensing of a beverage containing a liquid and a gaseous substance dissolved therein, the system comprising a container (10) suitable for containing said beverage and a device (92) according to any one of aspects C1 to C7.

D1. The device (96) for on-site dispensing of a beverage containing a liquid and a gaseous substance dissolved therein, the device comprising:

a dispensing means (60) for dispensing the beverage supplied to said dispensing means (60) from a conduit (40);

a pressure compensating means (86) disposed along said conduit (40) and configured to set a partialization of the beverage flow rate so as to obtain a corresponding compensation pressure (P82);

a measuring means (88) configured to generate a temperature measurement of said beverage at said pressure compensating means (86); wherein the control means (76) is configured to control the pressure compensating means (86) so as to set a flow rate partialization equal to a pre-partialization value determined on the basis of said temperature measurement, when the dispensing means (60) is in a non-dispensing status.

D2. The device according to aspect D1, wherein the pre-partialization value is directly proportional to the temperature measurement.

D3. The device according to aspect D1 or D2, wherein the control means (74) is configured to decrease said pre-partialization value when the dispensing means switches into a dispensing status.

D4. The method for controlling a device (96) for on-site dispensing of a beverage containing a liquid and a gaseous substance dissolved therein, said device (96) comprising a dispensing means (60) for dispensing the beverage, the method comprising:

supplying (S1110) the beverage to said dispensing means (60) by means of a conduit (40);

generating (S1120) a temperature measurement of said beverage at said pressure compensating means (86);

controlling (S1130) a pressure compensating means (86) so as to set a flow rate partialization equal to a pre-partialization value determined on the basis of said temperature measurement, when the dispensing means (60) is in a non-dispensing status, wherein said flow rate pre-partialization results in a variation in a compensation pressure in proximity to said pressure compensating means (86).

D5. The computer program comprising instructions that are suitable for executing the steps of aspect D4 when the program is run on a computer.

D6. The system for on-site dispensing of a beverage containing a liquid and a gaseous substance dissolved therein, the system comprising a container (10) suitable for containing said beverage and a device (96) according to any one of aspects D1 to D3.

LIST OF FIGURES

Figure 5A:
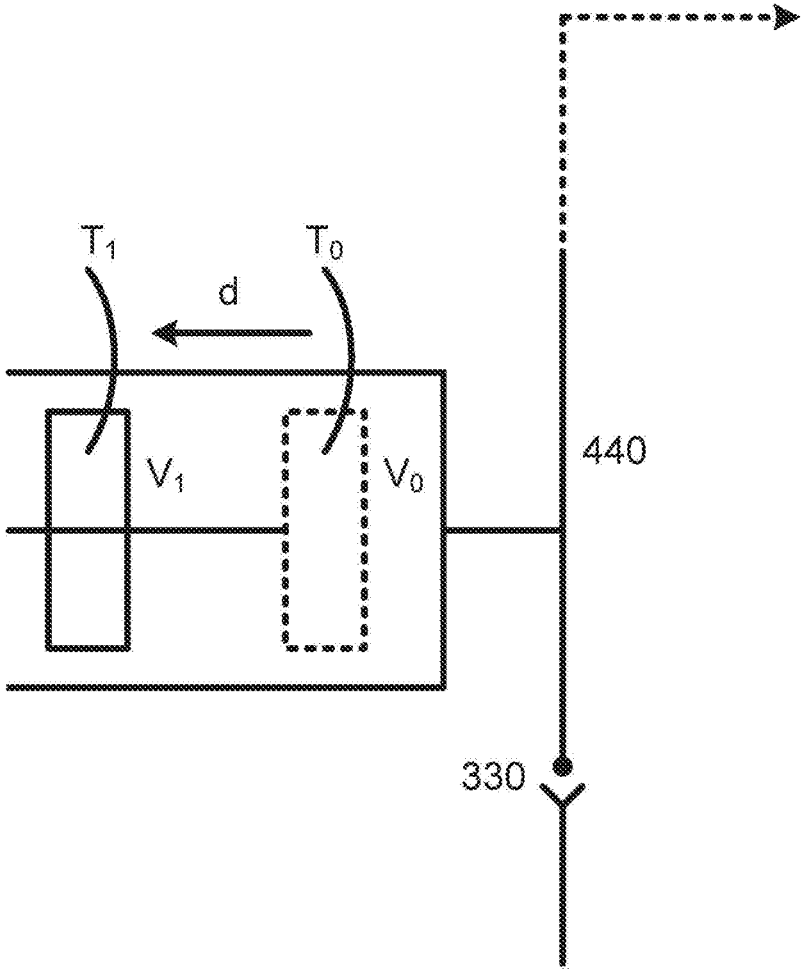
Figure 5B:
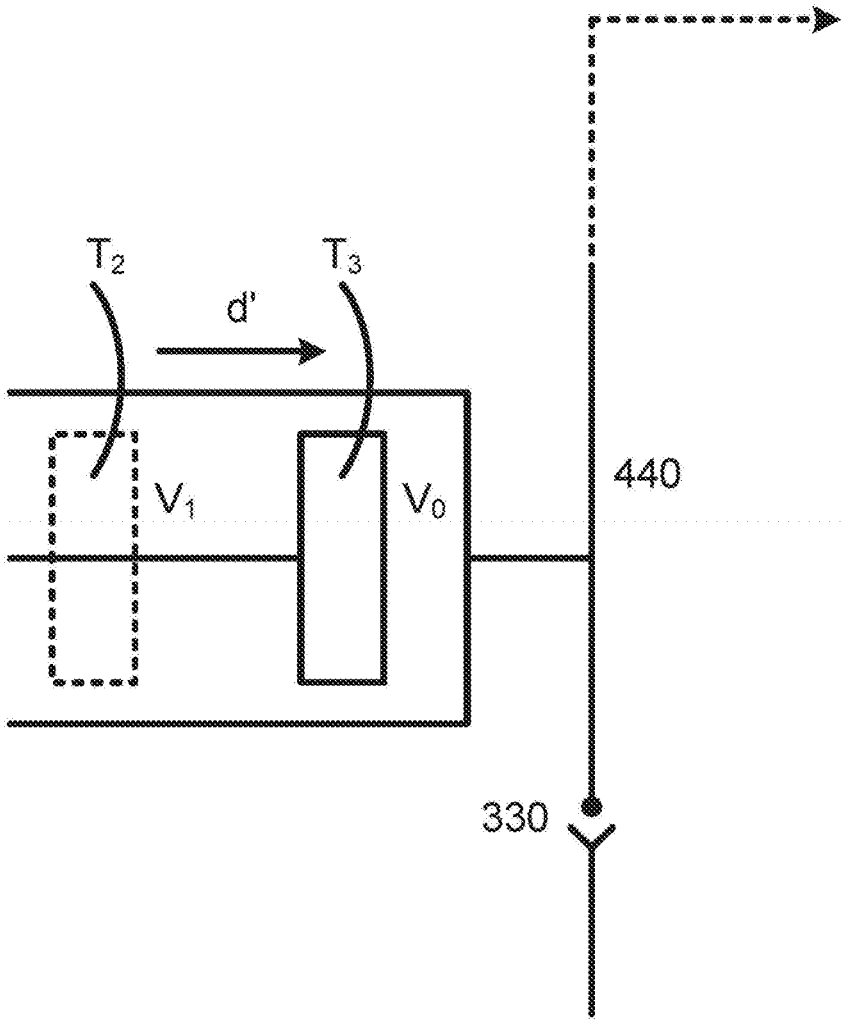
Figure 6:
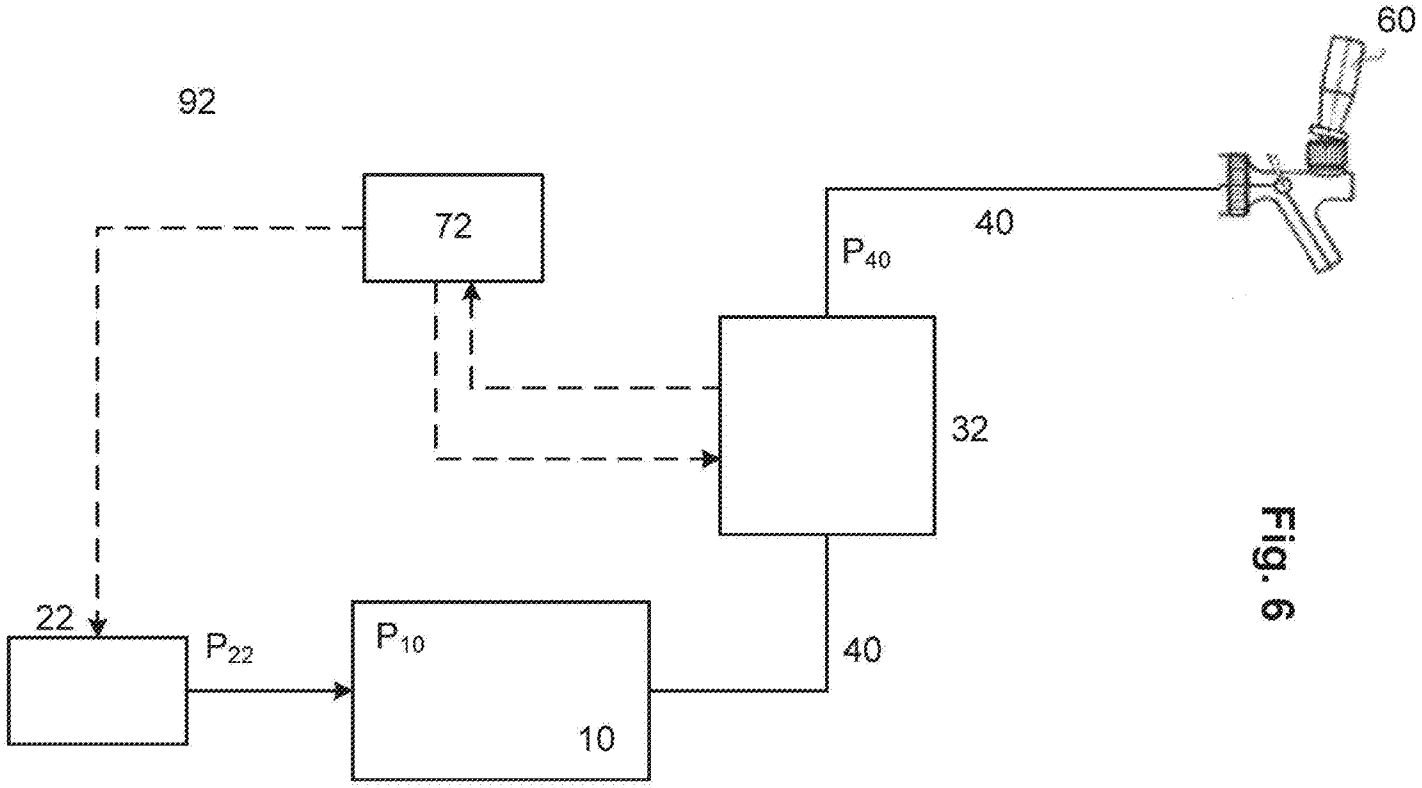
Figure 7:
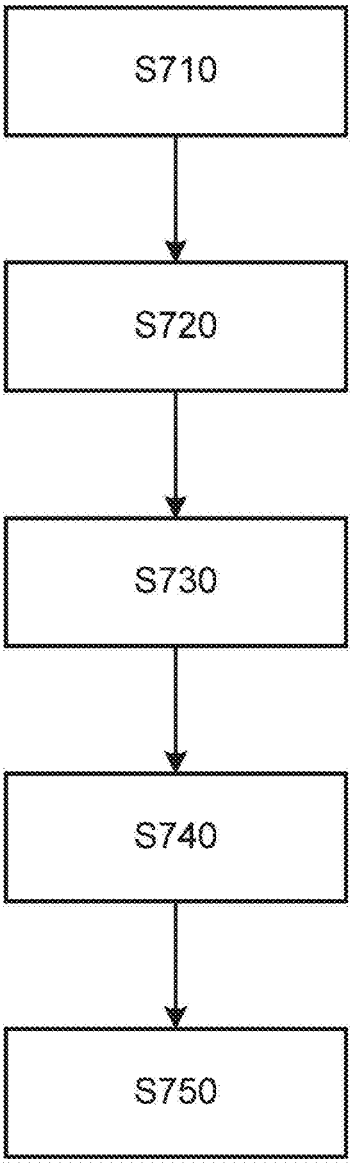
Figure 8:
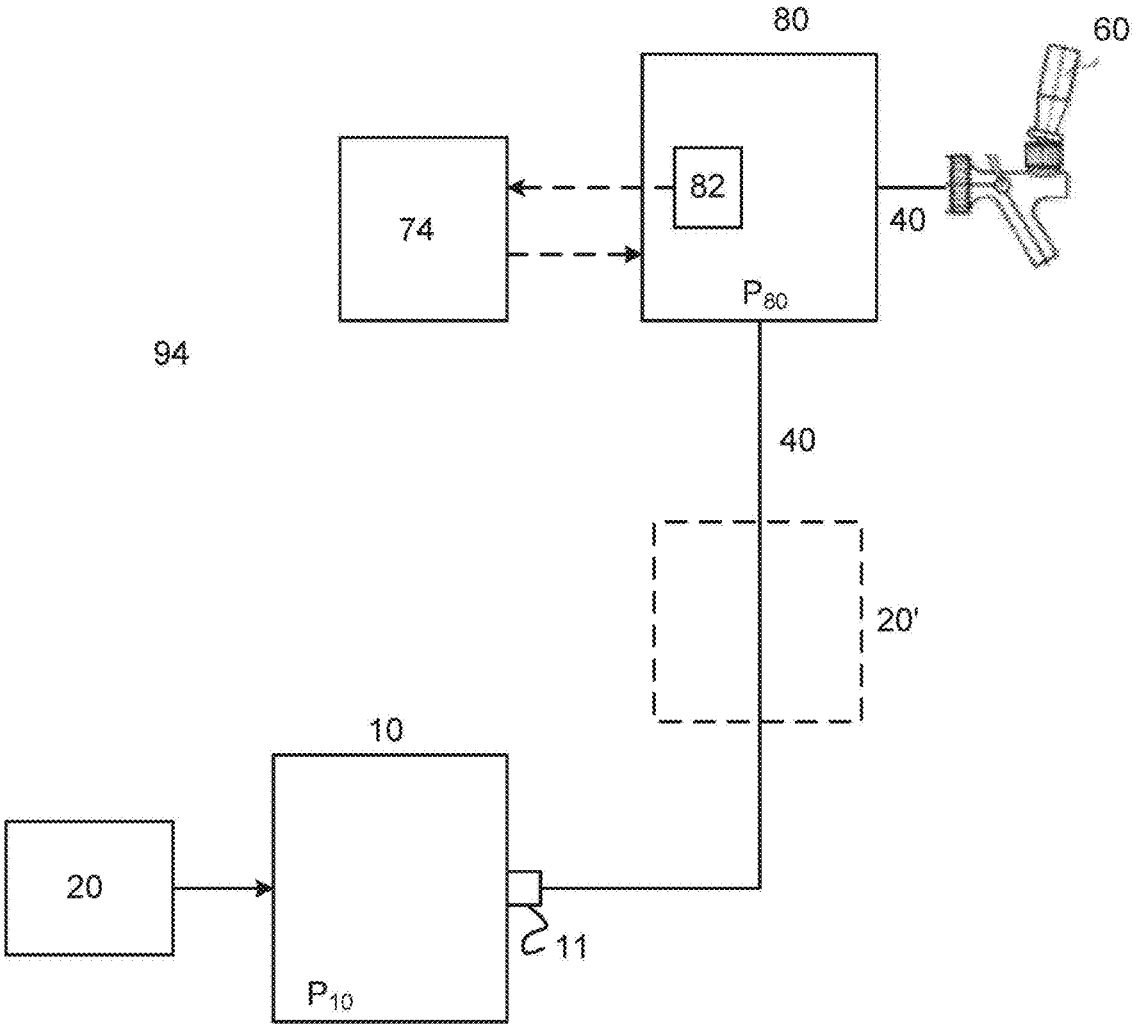
Figure 9:
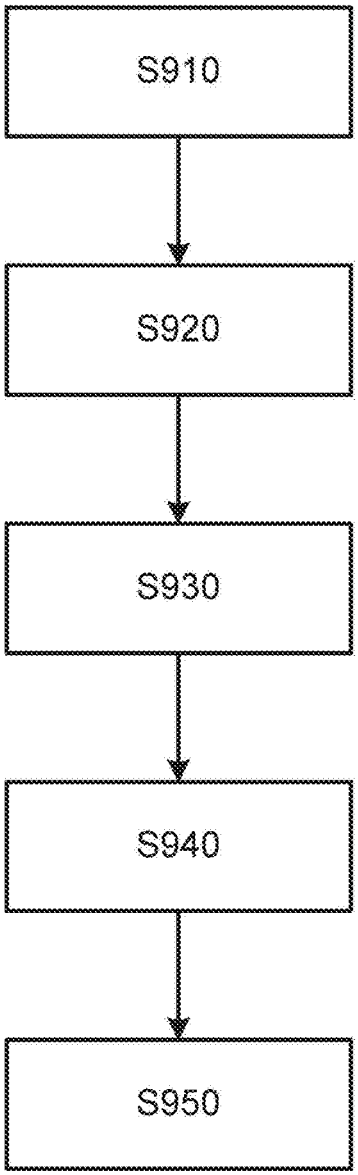
Figure 10:
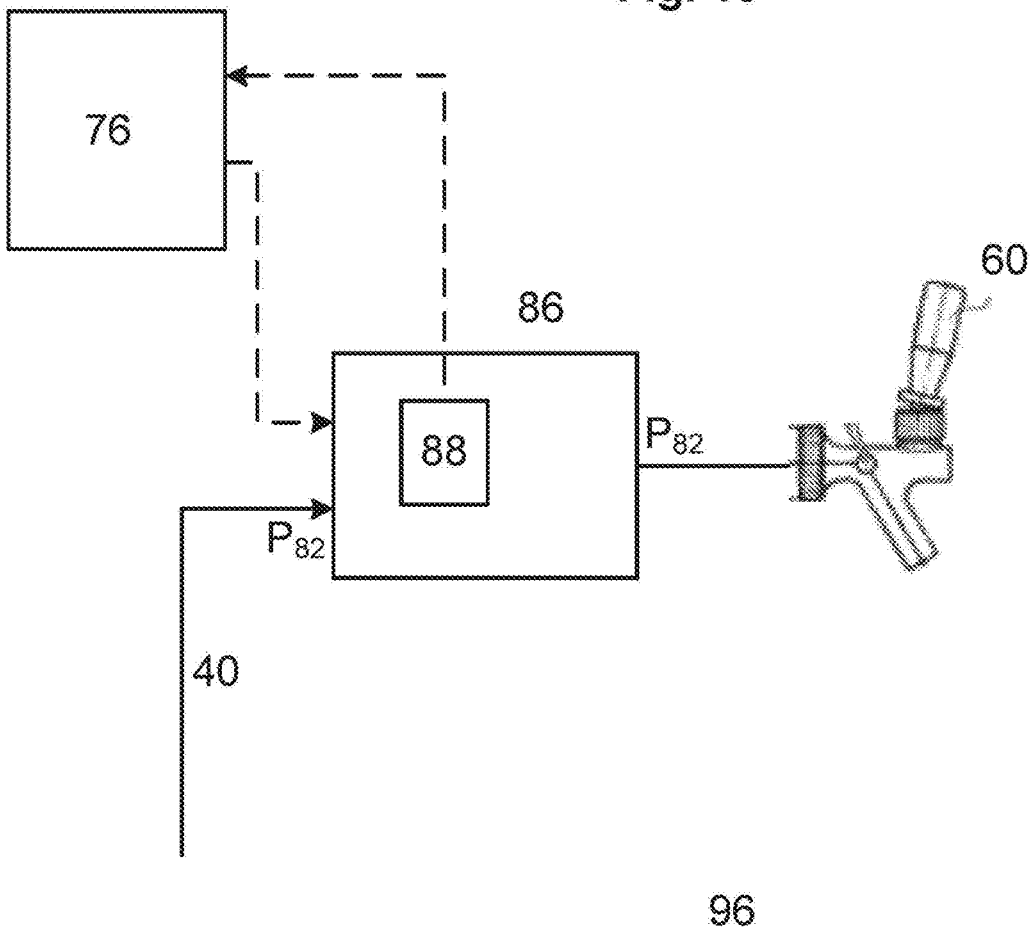
Figure 11:
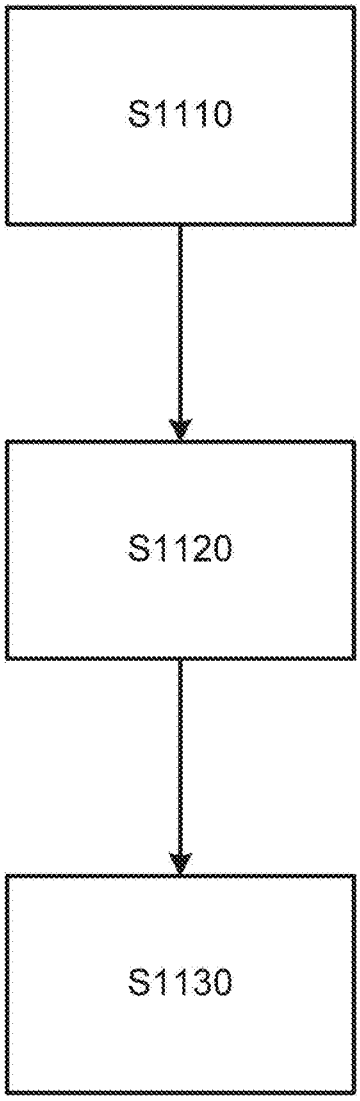
Figure 12:
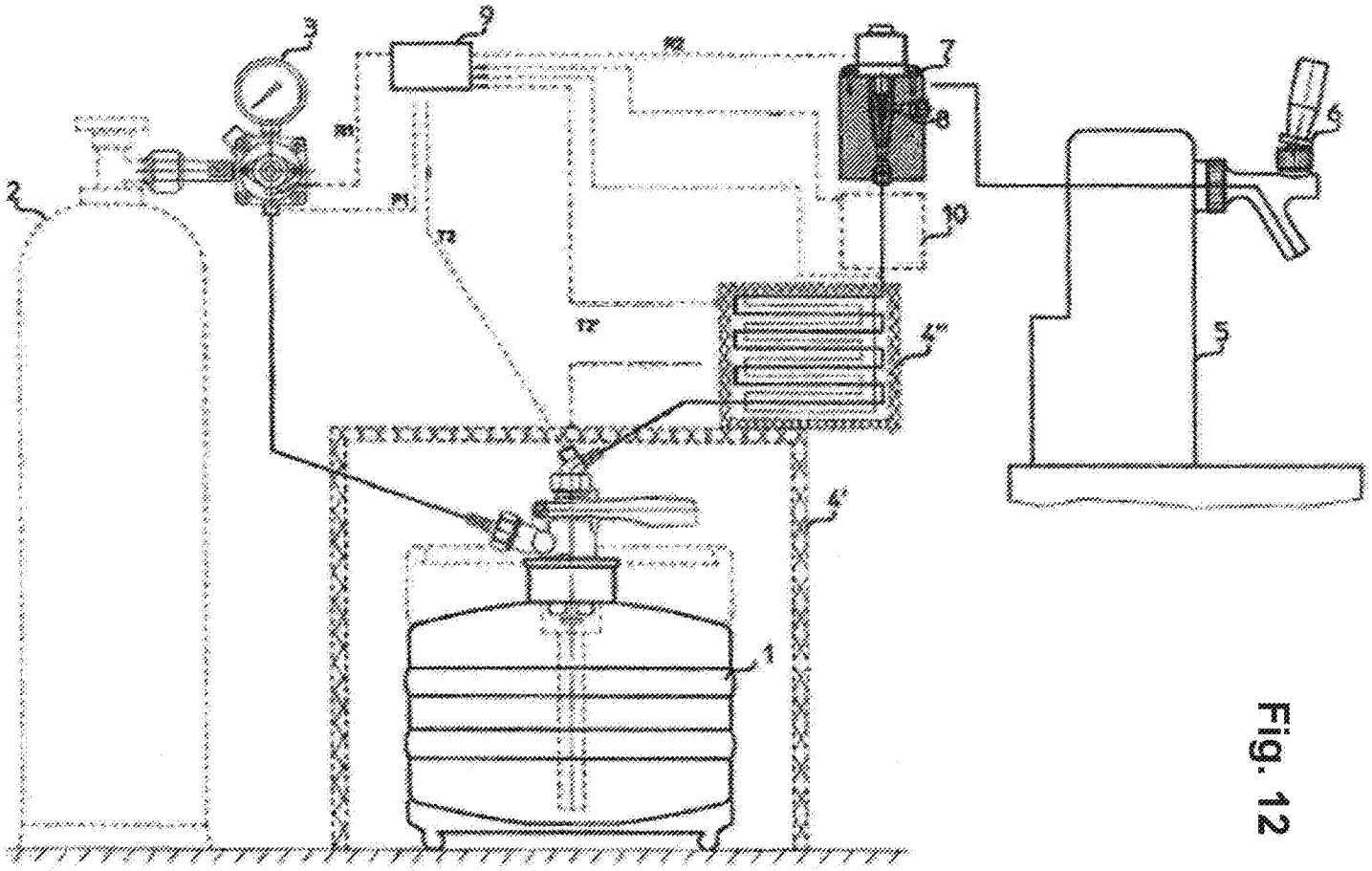
Figure 13:
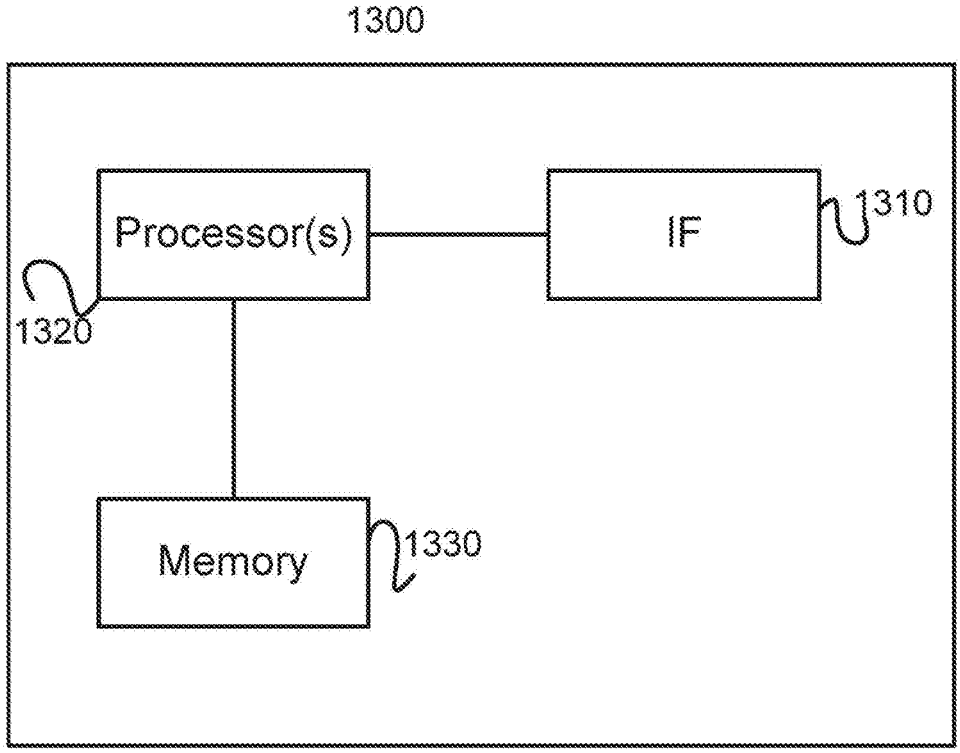
Figure 14:
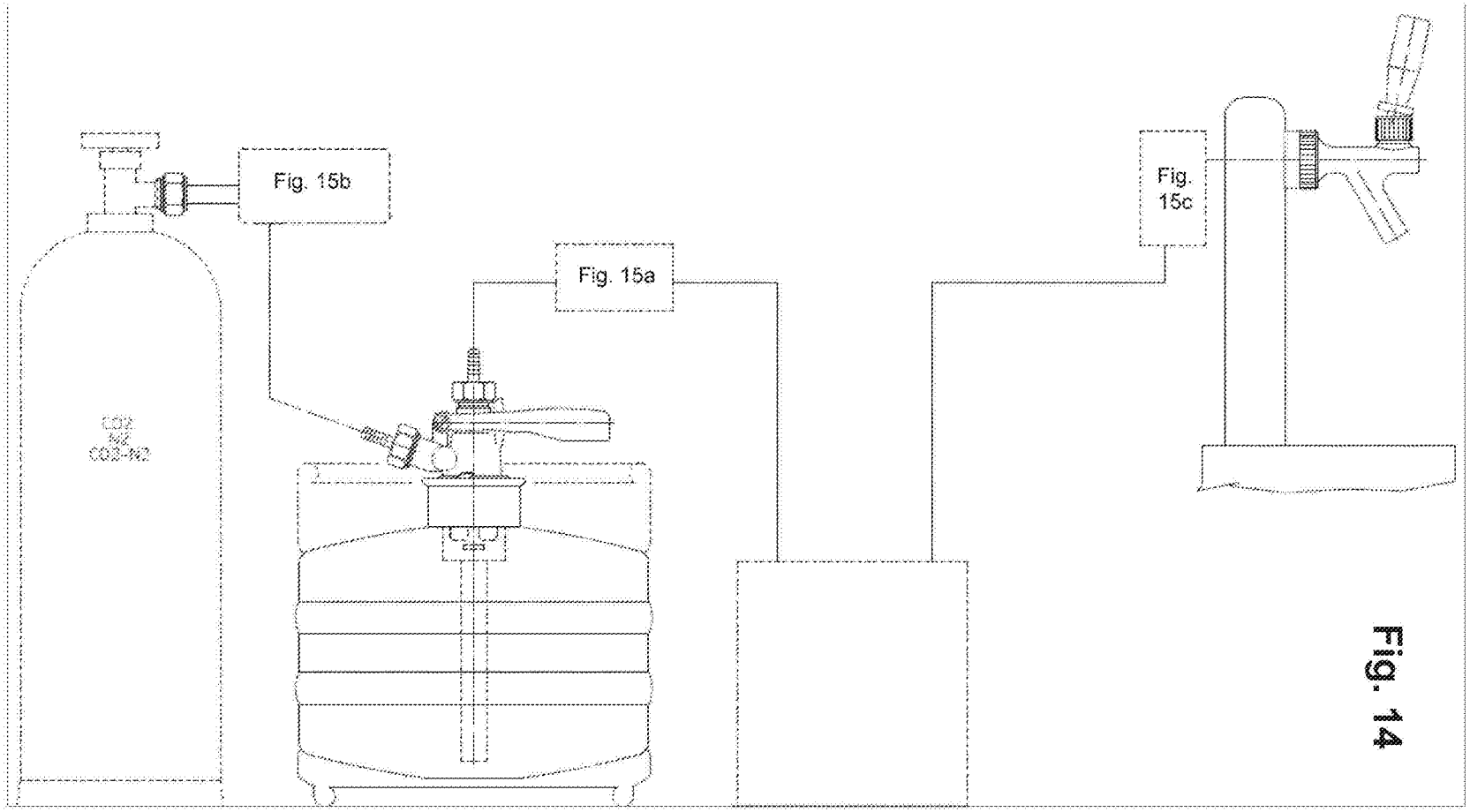
Figure 15A:
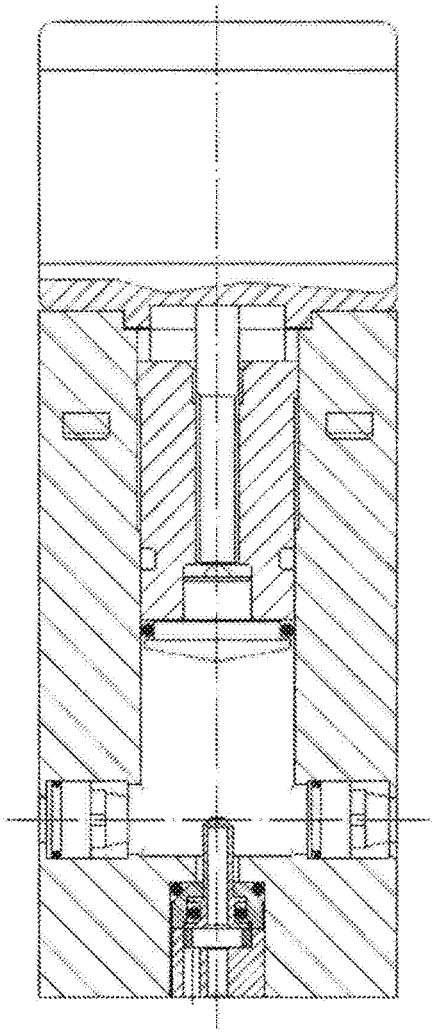
Figure 15B:
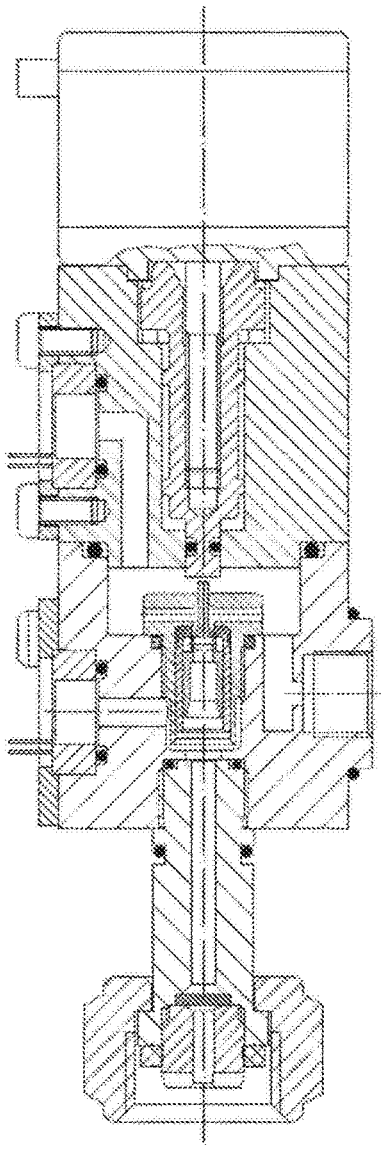
Figure 15C:
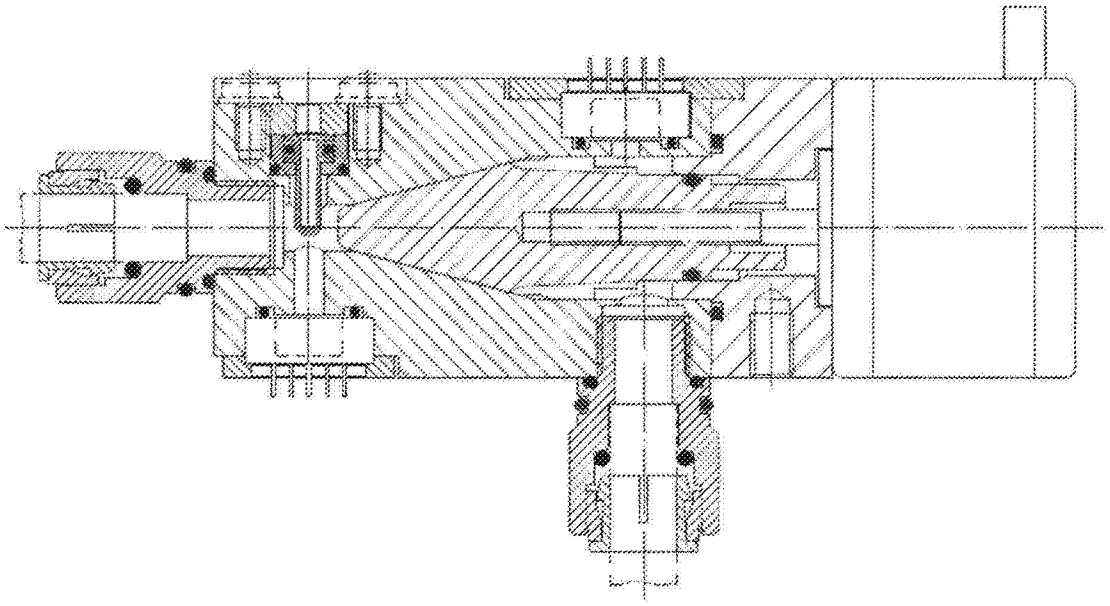

FIG. 5*a* is a diagram illustrating the operation of the piston in the suction phase;

FIG. 5*b* is a diagram illustrating the operation of the piston in the step of introducing liquid into the conduit;

FIG. 6 is a block diagram schematically illustrating a device according to a second embodiment;

FIG. 7 is a flow diagram illustrating the operation of the device of FIG. 6;

FIG. 8 is a block diagram schematically illustrating a device according to a third embodiment;

FIG. 9 is a flow diagram illustrating the operation of the device of FIG. 8;

FIG. 10 is a block diagram schematically illustrating a device according to a fourth embodiment;

FIG. 11 is a flow diagram illustrating the operation of the device of FIG. 10;

FIG. 12 is a block diagram schematically illustrating an example of a device to which one or more of the embodiments can be applied;

FIG. 13 is a block diagram of a computer capable of running a program according to one embodiment;

FIG. 14 is a diagram illustrating an example of a device on which it is possible to implement one or more of the embodiments described;

FIGS. 15A-C are enlarged views of constructive details of the device of FIG. 14.

Figure 16:
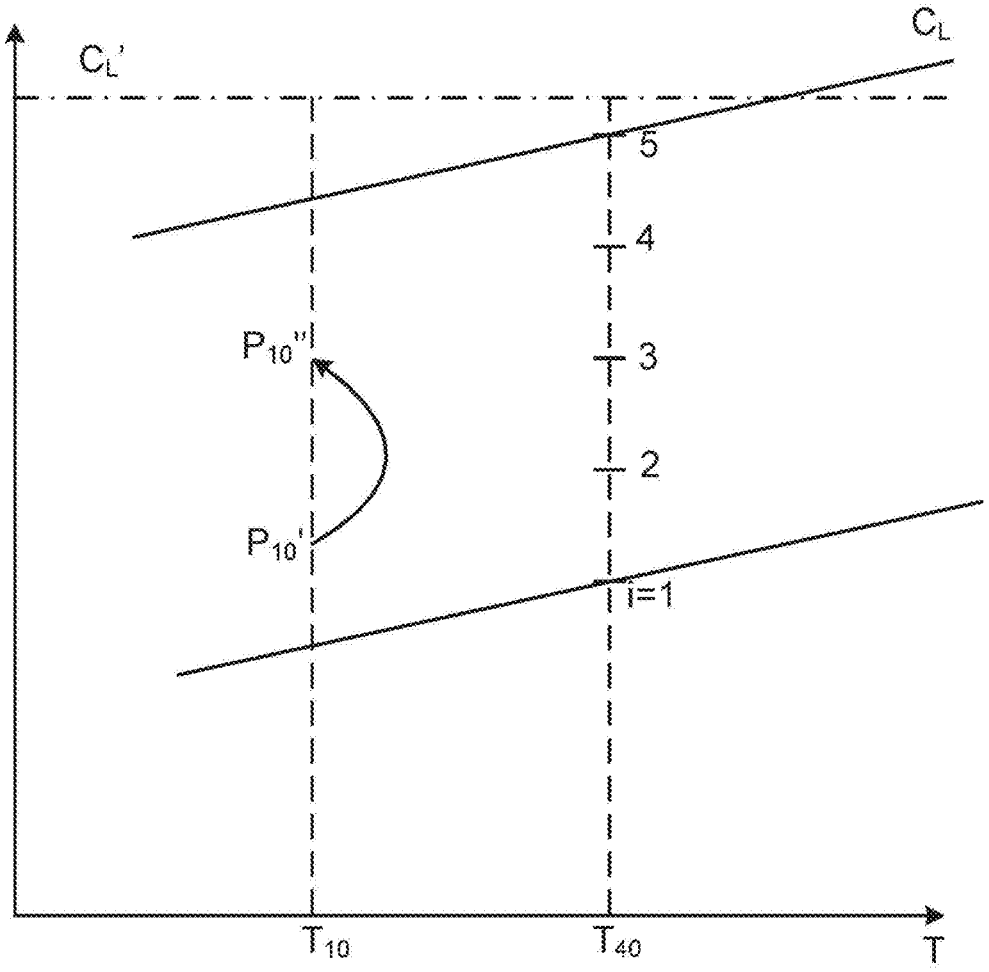

FIG. 16 is a diagram illustrating an example of the adjustment of pressure values.

DETAILED DESCRIPTION

Figure 2:
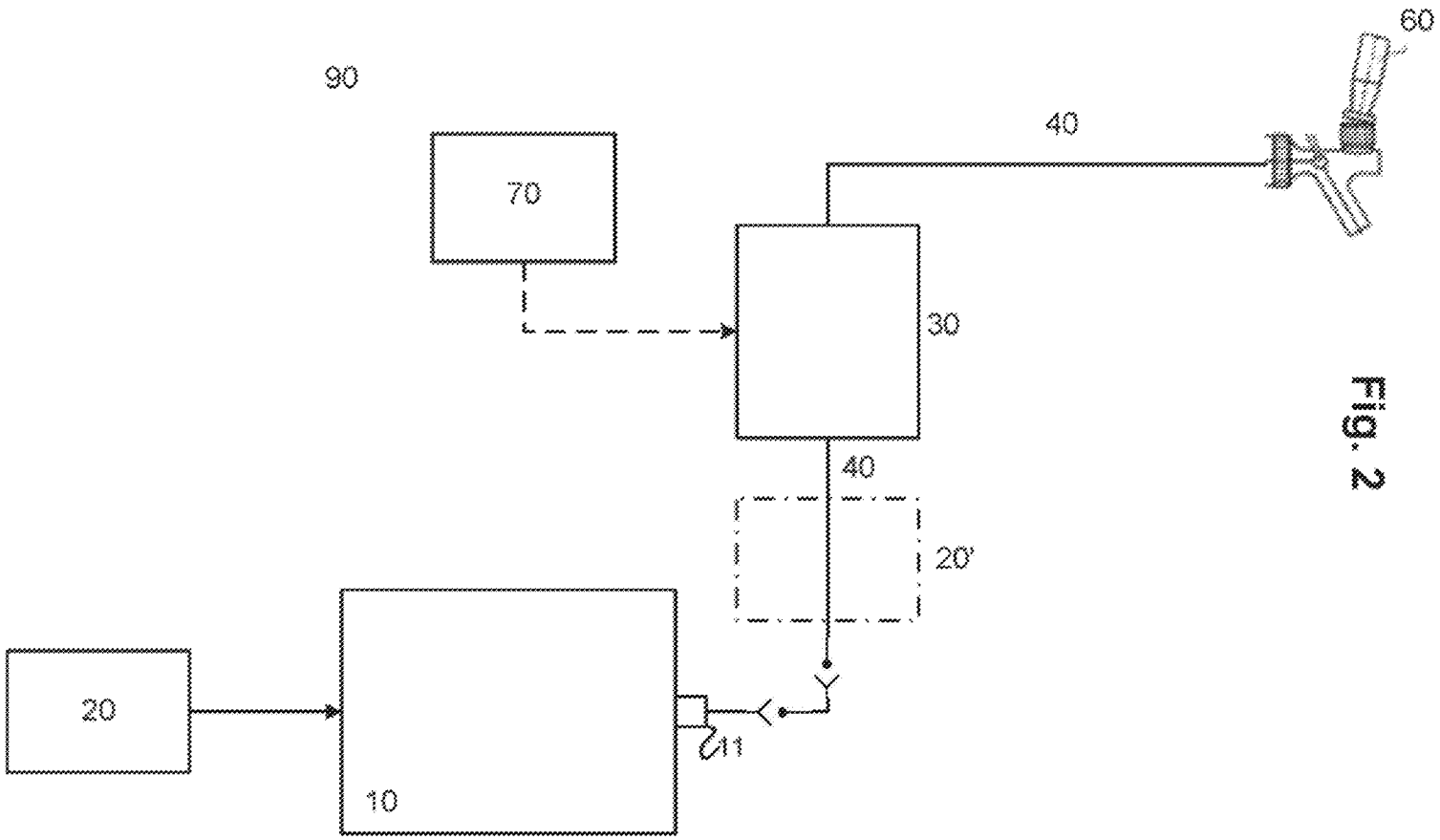
FIG. 2 is a block diagram schematically illustrating a device according to a first embodiment.
Figure 3:
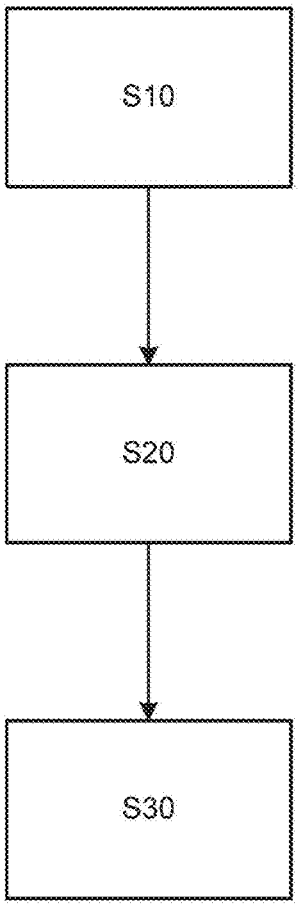
FIG. 3 is a flow diagram illustrating the operation of the device of FIG. 2.

A first embodiment will now be described with reference to FIG. 2, which illustrates a device 90 for on-site dispensing of a beverage containing a liquid and a gaseous substance dissolved therein. The gaseous substance can already be entirely dissolved in the beverage comprised in the container 10 (in the sense that the container contains the beverage already incorporating gas in the desired amounts), or else it can be entirely supplied from the outside (in which case the container contains the liquid without gas) or in part already dissolved in the liquid and in part supplied from the outside. Examples of a beverage to which the following applies are: beer, wine, water and any type of gas-containing soft drink (e.g. cola, orange soda, etc.), etc. Furthermore, on-site dispensing means that the dispensing is performed at the location of the end user of the beverage, from a container containing the same beverage and located on the same site as the user or in proximity thereto (for example in the cellar, while the dispenser is one or more floors above or below or on the same floor but not necessarily in the same room). The device 90 further comprises a dispensing means 60 for dispensing the beverage. In an example illustrated further below, the dispensing means 60 comprises a tap through which the beverage is dispensed. The device further comprises a container 10, a pushing means 20, a modulating means 30 and a control means 70. The container is not, however, strictly necessary for the purpose of configuring the device, and can be omitted for that purpose.

The container 10 is suitable for containing at least liquid necessary to obtain the beverage; the container 10 is connected to the dispensing means 60 by means of a conduit 40.

It is noted that the dispensing means is a means for partializing the flow, for example via a controlled mechanical (or electrical) tap, or by means of other flow modulating systems such as, for example, a regulating cone, which is also described further below. The conduit comprises at one end means for coupling with the container 10. The configuration of the device 10 in any case remains as described below even if the container is not connected. In fact, the device 90 can be manufactured, distributed and/or installed also without the presence of the container 10.

Figure 1:
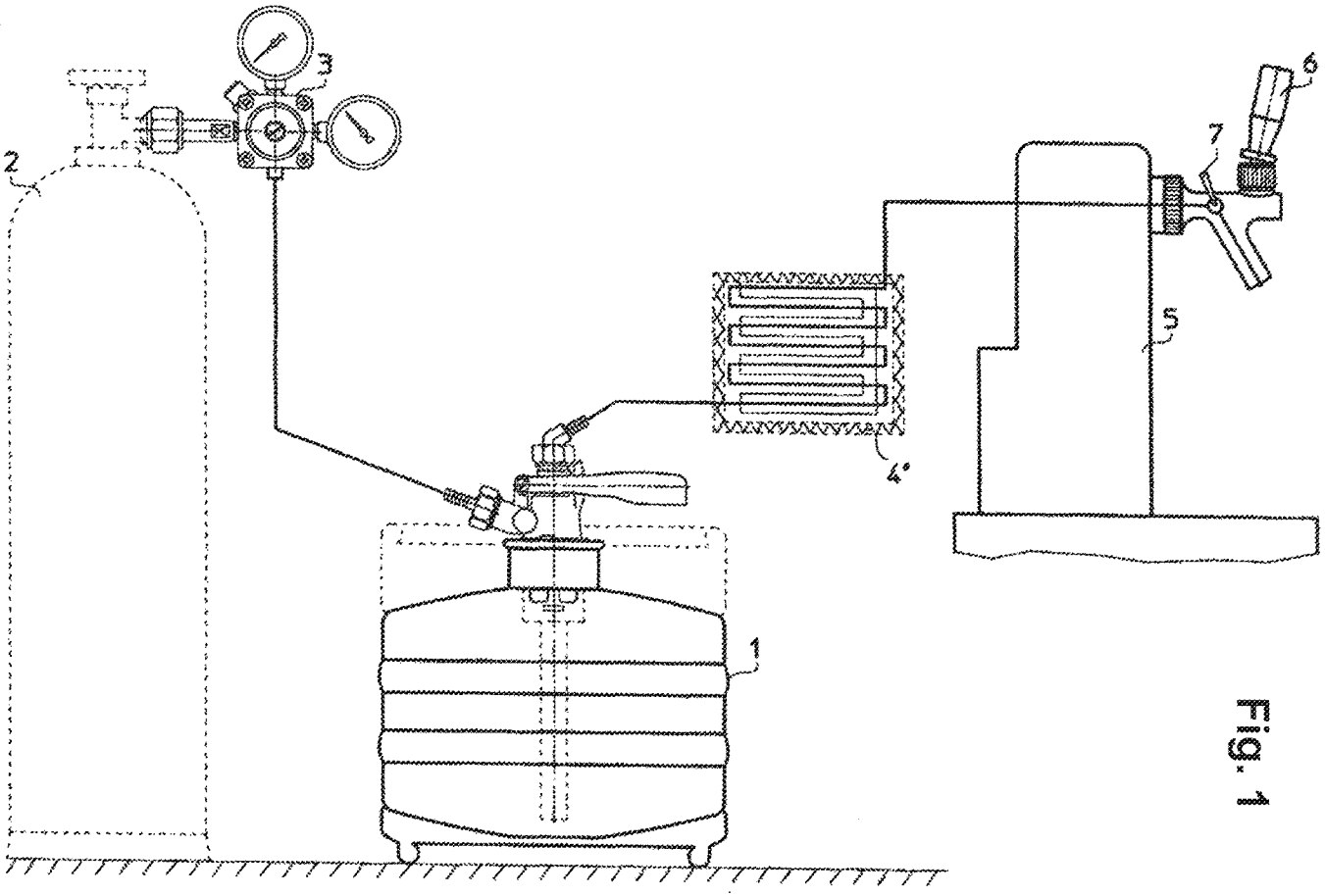
FIG. 1 is a block diagram illustrating a dispensing device according to the prior art.

The pushing means 20 is suitable for imparting to said beverage a push sufficient to enable the dispensing thereof via the dispensing means 60. In other words, the pushing means is capable of imparting to the beverage a certain pressure such as to enable the liquid/beverage to overcome the difference in height between the container 10 (i.e. the outlet point of the liquid from said container) and the dispensing means. Furthermore, by introducing pressure into the container 10, it is possible to control the carbonation or level of carbonation of the liquid contained (above all when the gas is CO2). For this purpose, it is not relevant how fast the glass is filled, as long as the pushing pressure is sufficient to bring a certain minimum amount (for example a glass or a portion thereof) to the tap in a given period of time. Preferably, the pushing pressure generated is such that the liquid arrives according to a predetermined dispensing condition, which means one or more parameters according to which the beverage should be dispensed. Examples of such parameters include: a certain flow rate such as to enable a container (e.g. a glass, cup, etc.) to be filled; a pre-established filling time; a certain pressure at the tap 60 obtained at the desired flow rate, for example to avoid the formation of foam; correction factors based on the type of beverage; any combination of these or other suitable parameters. In one example, the pushing means 20 illustrated in FIG. 1 comprises a tank 20 containing a gaseous substance under pressure (e.g. CO2, or N2, or a combination thereof), wherein the gaseous substance is introduced from the tank 20 to the container 10. A pressure reducer (not illustrated) can be interposed between the tank 20 and the container 10, as explained further below in an optional example; alternatively, there could be an adjustable compressor which introduces gas into the container 10. In another example, the pushing means 20' comprises a pump (or any other means suitable for providing pressure head) disposed downstream of the container 10 and configured to impart to the beverage the above-described push. The pushing means can further comprise a combination of the tank 20 and the pump 20', in which case the latter is in addition to the tank 20. It is noted, for the sake of completeness, that the pushing means 20' (pump) can be present both upstream and downstream of the modulating means 30, which will be described below.

The pressure modulating means 30 is configured to modulate the pressure of the beverage in the conduit 40, and it is capable, in particular, of modulating or adjusting the pressure of the beverage even when the beverage flow is zero by virtue of the varying means 60, i.e. when the varying means closes the outflow of the beverage (it should be noted that modulating means indicating the capacity of adjusting or varying the pressure value also with zero flow, for example it is capable of setting the pressure between two or more non-zero pressure values even in the presence of zero flow). As the person skilled in the art will immediately realize, a normal pump is not capable of performing such a pressure modulation, since at zero flow the pump is capable of supplying only the maximum pressure; at zero flow, in fact, such a pump is not capable of varying the pressure in the closed conduit. Examples of modulating means 30 include a piston with a check valve upstream thereof, a piston activatable in a discrete or continuous manner, as explained further below, a bag that can be expanded and compressed through the action of a mechanism or an external pressure (compressed air), a membrane activated in the same manner, or a peristaltic pump under given conditions as also illustrated further below. The modulating means 30 in any case comprises any other device capable of enabling a variation in the pressure, in a continuous or discrete manner, between a minimum value and a maximum value with the conduit closed (i.e. at zero flow), or among a plurality of non-zero pressure values. The fact remains that the modulating means 30 is capable of bringing about a variation in the pressure head of the beverage in the conduit when the tap is open as well. A check valve can be optionally disposed downstream of the container 10 and upstream of the modulating means 30, so that any greater pressure in the line will not alter the pressure set in the keg.

The control means 70 is configured to control the activation of the modulating means 30 in such a way that the latter varies the pressure in the conduit upon the occurrence of one or more predetermined conditions. For example, the control means can cause an increase in the pressure in the conduit if it is determined that the beverage in the conduit is in a state such as to generate foam during dispensing and/or if an increase in the temperature of the beverage is detected in the conduit when the flow is stopped, and/or if it is desired to prevent the formation of foam in the conduit at zero flow due to overheating of the conduit itself and/or in a state in which there is already foam in the conduit and it is desired to facilitate, with a greater pressure, the reabsorption of the gas into the liquid, for example when not dispensing.

Optionally, a predetermined condition is deemed to have occurred when a pressure value detected by a pressure sensor disposed along the conduit 40 becomes equal to or less than a predetermined value. The predetermined value can be, for example, set in such a way as to be equal to the value of the saturation pressure of the beverage at a certain temperature (or at such a value with the addition of a margin) which is deemed always higher than the one that can be reached in the conduit; therefore, when the pressure detected becomes equal to or less than said value, the device is capable of estimating that there is a risk of producing foam. Accordingly, the varying means intervenes to vary the pressure in the conduit in order to bring the pressure back beyond said predetermined value, thus reducing the risk or likelihood that foam will form. The pressure can fall, for example, due to dripping from the tap. Furthermore, and again optionally, the occurrence of a predetermined condition can comprise the occurrence that the activation of the modulating means 30 has reached a maximum pre-established activation value (for example: between two open statuses of the tap, or for a predetermined period of time during which the tap is in a closed status). For example, if the modulating means 30 has unsuccessfully attempted to bring the pressure in the line back above the predetermined value discussed above, the system can decide to stop the activation of the varying means, or possibly signal the presence of foam in the line without stopping the means 30; in the case of a system integrated with the pushing means, the system can control the latter so as to increase the pressure in the container (though not illustrated, in an optional configuration the controller can also be in communication with the means 20). Such a situation can in fact occur, for example, when there is a large amount of foam in the line without a sufficient amount of liquid to enable it to be reabsorbed, so that the varying means is ineffective or has to work under non-ideal or inacceptable conditions; above all when the tap is first opened there would be the risk of dispensing with excessive foam. A pressure value detected by the sensor was spoken of above: it should be noted, however, that instead of one value, a plurality of pressure values could be detected along the conduit 40, each of said values being compared with respective thresholds, or an average thereof relative to a predetermined value. Furthermore, although the pressure sensor or pressure sensors can be disposed along the conduit 40, it is preferable to measure the pressure in the point of the conduit that is deemed most critical for foam, for example the warmest one, which is usually the closest to the dispensing means; furthermore, it is usually also the one with the highest piezometric level relative to the container, hence the one with the least pressure when the flow stops. Furthermore, in addition to the pressure, the temperature could be also measured in the same points of the conduit 40 so as to be able to activate the pushing means 30 to set a pressure as a function of the measured rather than predefined temperature. In this case as well, the measuring points can be different along the conduit 40, but the most advantageous one is close to the dispensing means 60.

Optionally, in the device 90, the pressure modulating means 30 can be configured to force at least some of a component liquid of the beverage into the conduit 40. In other words, the means 30 is capable of introducing some liquid or beverage in addition to that already present in the conduit with the aim of increasing the pressure thereof (which would cause the foam, if present, to be reabsorbed), for example by means of a piston fitted with a check valve upstream, as described further below. In one alternative, considering, for example, a piston (or a compressible receptacle directly connected to the conduit), forcing the liquid into the conduit means moving the liquid or beverage via the piston (or compressible bag) to the conduit by activating the piston (or compressing the bag). Optionally, the pressure modulating means 30 can be configured to decrease the pressure in the conduit, for example when the same exceeds a predetermined threshold value. This can be obtained, for example, by means of a relief valve, via a piston activated so as to extract a certain amount from the conduit, a bag made to expand so as to suck in an amount of the beverage from the conduit, or with the same piston as described earlier, but activated in a reverse manner, etc. This would prove advantageous in certain situations where, for example, one wishes to avoid or reduce possible problems caused by water hammer, or where the pressure of the conduit becomes too high in view, for example, of the normal operating values of the device, or in view of the pressure values deemed acceptable for preserving the properties of the beverage. In particular, in order to prevent or limit the water hammer effects by means of the piston, the latter could be activated during dispensing of the beverage in such a way that, upon the closure of the dispensing means 60, it is still under suction, that is, with a motion that increases the available volume of the beverage in the conduit, thereby eliminating, in fact, the water hammer.

It is further noted that the beverage introduced, delivered or forced into the conduit is usually drawn in by the tank 10, thus upstream of the piston and check valve, or generically the pushing means 30.

Alternatively, it is conceivable to draw some of the liquid or beverage to be introduced not directly from the keg but rather from a separate container (in which case a system of solenoid valves will be needed, for example, to establish communication with the conduit or keg or other container).

Optionally, and as already mentioned, the pushing means 20 can comprise at least one of the introduction means (e.g. cylinder with gas under pressure) configured to introduce the gaseous substance into the keg or container 10 at a pressure such as to supply the aforesaid push, and optionally the right carbonation pressure for the beverage contained therein, or a pumping means 20', disposed downstream of the container and configured to pump the liquid/beverage coming out of the container itself.

Optionally, the pressure modulating (or varying or adjusting) means 30 is capable of adjusting the pressure of the beverage in the conduit 40 between a plurality of non-zero values even when the beverage flow is zero, including among these values the possibility of reducing the pressure in the conduit 40. For example, the modulating means 30 could be configured to set the pressure at a number n of pressures between a minimum value and a maximum value: $P_0<P_1<P_2< \ldots <P_N$, wherein $P_1$ can also be a zero value, with N>=1 (for example: $P_0$ and $P_1$ both not zero, or $P_0$, $P_1$, $P_2$ with at least two non-zero values). The fact remains that the modulating means 30 can also be capable of varying the pressure in a continuous manner between a minimum value and a maximum value, or of varying it alternatively in a continuous or discrete manner according to circumstances and not only increasing it compared to the initial pressure in the conduit, but also decreasing it.

Optionally, the control means 70 is configured to control the activation of the modulating means 30 when the dispensing means 60 is in a status in which there is no dispensing of the beverage. Therefore, it is possible to prevent or reduce the formation of foam also in cases where a long period of time elapses between two consecutive dispensing operations and the temperature of the beverage in the conduit 40 tends to increase as a result of the heating it is subjected to by the environment; such a situation, as has emerged from observations made, implies the risk of foam forming both in the non-dispensing status and in the subsequent dispensing step. In any case, the benefits of the invention are also to be found when the tap is open, since the pressure modulating means 30, by preventing gas from escaping from the beverage in the conduit 40 in the non-dispensing status, contributes in any case to keeping it away from the conditions favourable to the formation of foam during dispensing.

One of the advantages given by the modulating means 30 is thus that of being able to manage the pressure in the conduit 40, at zero flow, in the most appropriate manner depending on the circumstances and the particular type of conduit 40, independently of the push set in the container 10 by the means 20.

Optionally, the device 90 comprises a check valve disposed upstream of the modulating means 30 and a check valve downstream of the modulating means 30 (upstream and downstream relative to the beverage flow). The presence of such valves enables the pressure in the conduit to be adjusted advantageously, in particular it allows ample adjustment possibilities downstream of the modulating means 30, without having to rely on an oversizing of the modulating means 30.

In a non-limiting example, the modulating means 30 comprises a piston and a check valve upstream, a system suitable for delivering at least some of a component liquid of the beverage (or an amount of that beverage) into the conduit 40, wherein said system enables a variation in the pressure of the beverage in the conduit 40. The piston can be positioned in such a way that it is able to draw the beverage from the conduit and reintroduce it into the same; in such a case, the device is advantageously positioned immediately downstream of the container 10 (in this case, it could draw in liquid during dispensing). A case in which the piston-valve system draws the liquid or beverage directly from a point in the section of conduit 40 upstream thereof or from a second container not shown in the figure is however also conceivable.

Optionally, the device 90 can also comprise a second check valve disposed downstream of the piston: in such a case, it is possible to activate the piston repeatedly, since the check valve downstream prevents the liquid from being sucked back in from the downstream part of the conduit, and the check valve upstream prevents the liquid introduced into the conduit from flowing back towards the container 10. By making the repeated activation of the piston possible, it is therefore possible to obtain a certain increase in pressure by means of a piston of smaller size than in the case where it is desired to obtain the same increase in pressure by means of a single piston stroke. The maximum pre-established activation value, in the case of the piston, can be defined as the maximum pre-established distance that the piston can travel, in a given direction, in one or more piston strokes; it can therefore be equal to a fraction of a stroke, an entire stroke or a fractional or multiple whole number of strokes, where stroke means the distance between a bottom dead centre and a top dead centre of the piston. Clearly, this definition of the maximum pre-established movement of the piston is in relation to the maximum pre-established volume of liquid that the piston can introduce into the conduit 40, and it is thus an indication of the pressure variation that the piston is able to reach in the conduit. Said movement can depend on the type of conduit 40 or its size and structural rigidity and/or the amount of gas present along the whole conduit, also in the form of microbubbles, and is thus an indication, an indirect measure, of the amount of foam that has formed in the conduit 40; foam which, becoming compressed, obstructs the pressure variation that the piston is able to reach and/or impose in the conduit. Thus, the maximum number of activations or the maximum stroke fraction allowed will be in relation to the maximum amount of foam allowed in the conduit (in the form of microbubbles distributed along the whole conduit). If, during operation, the total movement in an operating cycle of the piston reaches the maximum pre-established movement without succeeding in reaching the desired pressure increase, the device 90 can cause the activation of the piston itself to be stopped and signal the presence of foam in the conduit.

Optionally, in the device 90, the occurrence of a predetermined condition comprises detecting that the modulating means 30 is not capable of increasing the pressure up to a predetermined value; upon the occurrence of that condition, the control means is configured to control the pushing means in such a way as to cause an increase in the pushing pressure in the container 10. In other words, if the device 90 should determine the inability of the varying means to reach a predetermined pressure value, that is, the inability thereof to prevent the formation of foam due to an excessively small push in the container 10 (for example because the beverage contained therein is very cold), the control means is configured to act on the pushing means so that the latter provides more pressure to the liquid exiting the container 10 and therefore the increase in pressure caused by the pushing means contributes to reducing the possibility of foam forming. By appropriately choosing the predetermined value, it is possible to have the pushing means intervene more or less frequently in combination with the action of the varying means. Determining that the varying means is not capable of (sufficiently) increasing the pressure comprises measuring the pressure in the conduit and comparing it with a predetermined value, advantageously with the value of the push present in the container 10, and detecting the entity of activation of the modulating means 30 in an operating cycle thereof. In the example of the piston, the entity of the piston's movement in an operating cycle (comprising one or more consecutive piston strokes) gives an indication of the degree of the pressure increase: therefore, if the piston reaches a maximum pre-established activation value, the device 90 will determine that the piston is not capable of generating a sufficient pressure value, due to the excessive foam in the line, or, therefore, of causing the foam formed to be reabsorbed into the liquid in the conduit 40.

The example and/or optional aspects illustrated above can be combined with one another in any combination whatsoever. Thanks to the device illustrated it is possible to avoid, or at least to reduce, the possibility of foam forming during dispensing of the beverage, thus making it possible to set, in a traditional dispensing system, pushing pressures that are lower and closer to the saturation value of the beverage contained therein, thereby ensuring savings in gas and a better quality of the beverage.

The first embodiment has been described above with reference to a device. The same considerations apply, however, to the case of a method for on-site dispensing of a beverage containing a liquid and a gaseous substance dissolved therein, wherein the device 90 comprises a dispensing means 60 for dispensing the beverage. The method comprises a step S10 of supplying the beverage to the dispensing means 60 by means of a conduit. In a subsequent step S20, a push to be imparted to a said beverage is caused (e.g. caused by means of a processor which controls a respective pushing means, or caused by means of a setting of the pushing means itself), the push being sufficient to enable the dispensing of the beverage via the dispensing means 60 according to a predetermined dispensing condition. Furthermore, according to a step S30, the pressure in the conduit 40 is modulated (or varied or adjusted, using other terms to express the possibility of adjusting the pressure between two or more non-zero pressure values even at zero flow) upon the occurrence of a predetermined condition.

Optionally, in the method described here, the step S30 of varying the pressure in the conduit 40 comprises forcing at least some of a component liquid of said beverage into the conduit 40.

Optionally, again according to the method described here, the step S30 of varying the pressure in the conduit 40 comprises activating a piston, the piston being suitable for delivering at least some of a component liquid of said beverage into said conduit, the piston thus allowing the pressure of the beverage in the conduit 40 to be varied.

According to an alternative of the first embodiment, a computer program is provided (for example a microcontroller comprised in an electronic system) comprising instructions that are suitable for executing the steps of the method and/or of the variants thereof described above when the program is run on a computer.

By virtue of what was described above, it is possible avoid or at least reduce the formation of foam, especially after long pauses between two consecutive dispensing operations. In fact, as deduced from observations, also if the temperature in the keg remains constant within certain limits (for example, in the case of a keg in cold storage, or the temperature of the beer in a chiller, if the container is at room temperature and the beverage is chilled immediately downstream of the container during its flow towards the dispensing means), the temperature in the conduit could increase undesirably beyond certain limits, such as to cause or facilitate the formation of foam. The problem also exists when the conduit is cooled by special means, since the latter prove insufficient, especially for long conduits or prolonged intervals of time. Thanks to the solution described, by contrast, it is possible to increase and vary the pressure inside the conduit in such a way as to favour the reabsorption of foam or avoid the formation thereof. In other words, the system keeps the line safe from the formation of foam irrespective of the push that is present in the keg thanks to the variation of the pressure in the conduit. Furthermore, important information can be derived from the management of the pressure along the line, or the activation of the pressure varying means, such as the presence and/or the amount of foam present in the line, and this information can be used for a further control as described further below. Other obtainable information is when the line is empty because the keg has run out, or the presence of leakage in the line. Furthermore, if the activation reaches a certain maximum value, it is possible to deduce that the varying means is not capable of reabsorbing the foam or that too much of it is forming, and the device will thus determine that it is necessary to increase the pushing pressure in the container. Furthermore, thanks to the possibility of decreasing the pressure in the conduit, it is possible to prevent situations of overpressure, which could, for example, cause excessive wear on the conduit compared to the normal system operating conditions and/or it can contribute, for example, to attenuating water hammer if configured to work in a suction mode (thus increasing the volume in the conduit) during the step of stopping the dispensing flow.

Figure 4:
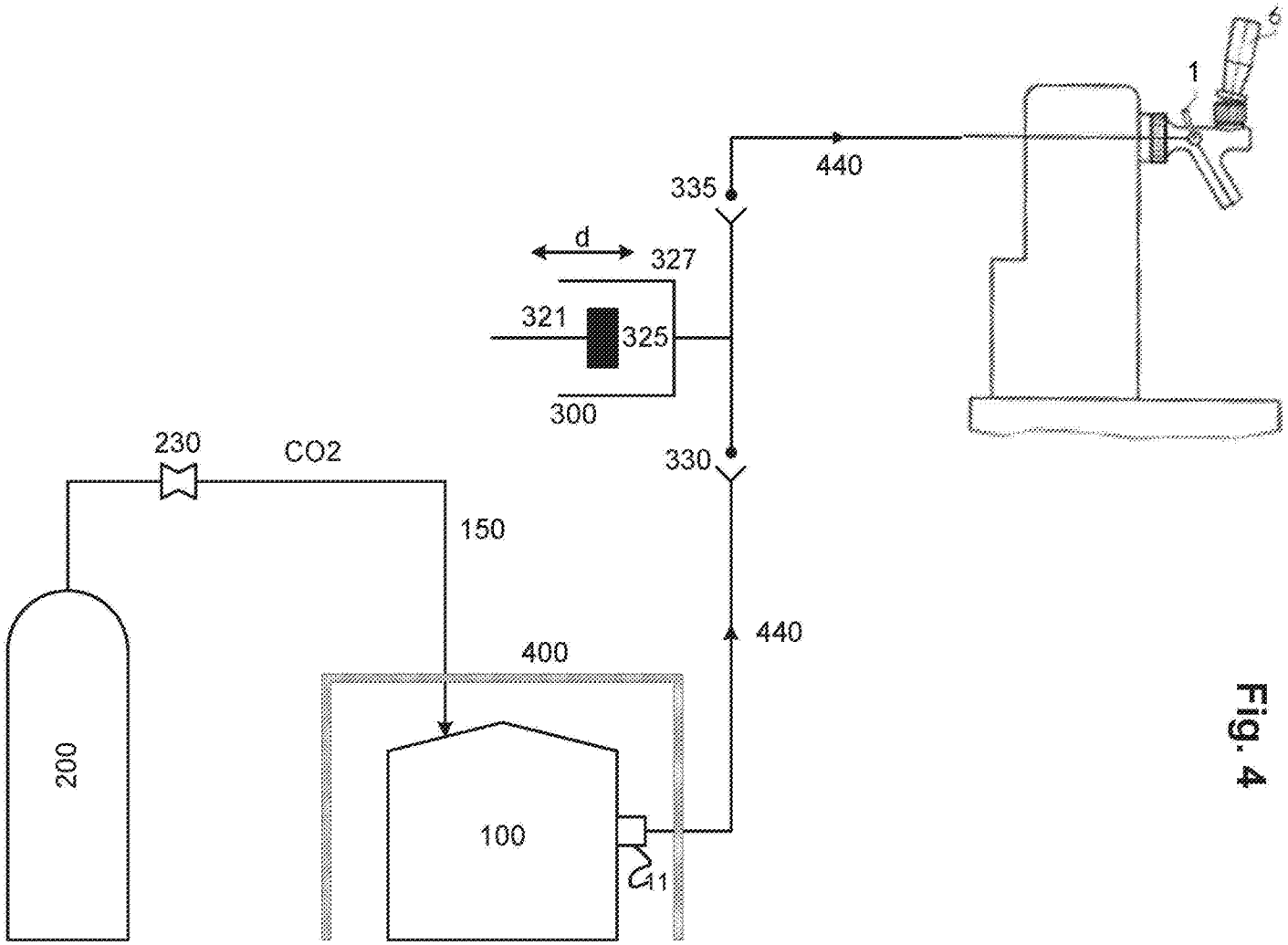
FIG. 4 is a block diagram representing an example based on a piston according to the first embodiment.

FIG. 4 illustrates an example according to a first embodiment, wherein the varying means 30 is represented by a piston 325 and two check valves 330 and 335. In particular, it shows a container 100, such as, for example, a keg, suitable for containing the component liquid of the beverage or the beverage itself, a tank 200 for storing the gaseous substance under pressure, and a pressure reducer 230 disposed between the tank 200 and the container 100. The container 100 can be comprised inside a refrigeration system 400, noting that the refrigeration system can also be extended to the conduit or part of the conduit 440 and in this case the refrigeration system 400 need not be present and the keg can be at room temperature. The tap is an example of the dispensing means 60 described above.

In the example illustrated in FIG. 4, the varying means 300 comprises a piston 325 moved by means of a rod 321, wherein the piston moves inside a chamber 327 in communication with the conduit 440 (it is noted that the length of the sections 440 before and after the piston are symbolic; in particular, the piston can optionally be disposed immediately at the keg outlet). The travel of the piston represents a stroke in the suction or introduction direction (see the directions indicated by the arrows "d"). The example envisages two check valves 330 and 335 disposed respectively upstream and downstream of the piston. Since the cylinder 327 is in communication with the conduit 440, it is possible to draw in and introduce the liquid into the conduit according to the operation of the system illustrated below.

In particular, FIG. 5*a* refers to the case in which the piston draws the liquid from the conduit 440: as the piston is moved in the direction of the arrow d, the volume inside the chamber varies from $V_0$ at time $t_0$ to $V_1$ at time $t_1$. The volume $\Delta V$ ($=V_1-V_0$) is thus filled with the liquid drawn from the line. During the discharge or introduction of the liquid into the conduit, the piston is activated in a reverse direction, namely, in the direction indicated by the arrow d' in FIG. 5*b*. Therefore, the volume $V_1$ at time $t_2$ decreases to the value of the volume $V_0$ at time $t_3$ ($V_0$ at time t3 can be equal to or different from $V_0$ at time t0; similar considerations apply for $V_1$). Thanks to the presence of the check valve 330, the liquid serves to vary, in particular to increase, the pressure inside the conduit 440, and hence to bring the liquid in the conduit back into situations of safety, i.e. conditions further away from the ones that can potentially create foam and, if it is present, conditions in which the reabsorption of gas into the liquid is faster. In the presence of a single check valve 330, the piston has an effect that is limited to only one stroke in only one direction. By inserting two check valves as in FIG. 4, by contrast, it is possible to establish a piston operating cycle comprising a plurality of strokes in succession, thereby creating a micro pump. As mentioned above, the pressure varying means is not limited to the use of a piston; in fact, it is also conceivable to use an elastic bag that can be expanded or compressed. Alternatively, it is possible to think of using a peristaltic pump which draws liquid from the conduit, or directly from the beverage container. By virtue of its construction (different from that of other pumps), a peristaltic pump can in fact allow the pressure to be varied between different non-zero values also at zero flow. In the case of a peristaltic pump it is advantageous that the latter draws the beverage from another container so as not to be an obstacle to the flow in the main conduit during dispensing.

The first embodiment can also be illustrated by means of this illustrative algorithm for varying the pressure in the line, preferably with the tap closed (with reference to beer, but similar considerations apply for other beverages):

Input Data
Tap status (open, closed)
Compensator inlet pressure [bar] with the tap closed
Pressure in the keg
Output Data/Commands
OK or fail/activation of varying means
Other Parameters
Piston dimensions (piston+2 check valves):
stroke: 10 mm
diameter: 15 mm
maximum pressure obtainable at motor stall: 12 [bar]
diameter of the check valves: ⅜" corresponding to the standard size of a beer delivery line
Pressure to be set in the line by means of the piston: 4.5 [bar]
Piston restart pressure: 3.5 [bar]
Operation of Algorithm A Every time dispensing takes place the piston carries out a complete loading and unloading movement. This cycle corresponds to an attempt to pressurize the line. If 4.5 [bar] is reached the attempt is considered "ok" and the piston stops until the pressure falls below 3.5 [bar], or until the next dispensing takes place; if it is not successful, the attempt is considered a "fail"; in this case the piston will perform another cycle.

A system that pressurizes the beer line without varying the pressure of the CO2 in the keg must preferably be positioned immediately after the keg so that its action involves the whole line. This applies both for a piston system and a peristaltic pump system. The disadvantage of the latter solution resides in the fact that a peristaltic pump must also operate with the tap open, as otherwise there would be no passage of beer, or that it would have to draw from another container.

In the following part of example, a pressure sensor is used on the compensator, preferably attached to the dispensing tap; the process is stopped upon reaching a desired pressure, which is decidedly higher than that in the keg so as to ensure the rapid absorption of any CO2 present in the line.

A decidedly higher pressure can be imposed in the line so as to prevent foam or cause it to be reabsorbed more quickly if it has begun to form during the last dispensing operation (this proves particularly useful when one seeks to impose the right pressure in the keg only looking at the temperature of the beer inside it). Clearly, by activating the piston it is possible to induce a pressure in the line such as to avoid the formation of foam.

With reference to FIG. 6, a second embodiment relating a device for on-site dispensing of a beverage containing a liquid and a gaseous substance dissolved therein will now be described. Unless indicated otherwise, what was said above also applies to the present embodiment and the variants thereof, also optional.

The device 92 comprises a dispensing means 60, a conduit 40, a means for indicating the presence of foam 32, a partialization means 22, and a control means 72. The conduit 40 is configured to supply or is suitable for supplying the beverage to the dispensing means 60. The conduit 40 further comprises a connection means 11 for connecting the conduit 40 to a container 10 suitable for containing at least liquid for obtaining the beverage. The means for indicating the presence of foam is configured to provide an indication of the presence of foam and preferably also the amount thereof in the conduit and is thus disposed along the conduit itself. Examples of a means for indicating the presence of foam include: an ultrasonic bubble detector such as the ones used, for example, in fields like dialysis, a sensor capable of detecting the passage of bubbles (and optionally the size and amount thereof), or a sensor (for example optical) which indicates the presence of gas in the conduit. In another example, the pressure varying means 30 discussed above, such as, for example, the piston, can be used for this purpose, and is thus a further example of a means for indicating the presence of foam. In fact, as discussed above, it is possible to detect, in a given operating cycle, the degree of activation of the pressure varying means; a presence of foam in the line implies an over-activation of the pressure varying means. Therefore, if the degree of activation of the pressure varying means exceeds a predetermined value, the device 92 will be capable of determining the presence of a certain amount of foam in the line and/or based on the entity of the activation value in relation to the pressure obtained as a result of the activation (indication of the amount of foam in the line). The pre-established value can be set on the basis of experiments and calibrations (to be performed at the time of designing, manufacturing and/or installing the device), so that it indicates a certain amount of foam present in the line. The amount of gas in the line can also be calculated once the piston volume, the volume in the conduit, the number of activations and the starting and final pressures obtained are known. It is further conceivable to establish different degrees of activation, each corresponding to a different level of foam present in the line. In the case of the piston, the degree of activation is represented, for example, by the total movement that the piston carries out in one direction in a single operating cycle, where operating cycle also means a number of successive strokes following the command to increase the pressure in the conduit.

In the case of the piston with an upstream check valve as the instrument for indicating foam in the line, it is advantageous to position it immediately after the keg, at the start of the line, since its activation does not give reliable indications of the state of the conduit upstream of the check valve. By placing it after the keg, one advantageously has a monitoring of the entire line. In the case of bubble sensors, it is preferable to position at least one immediately downstream of the keg and one immediately before the dispensing means in such a way as to have a measurement of the bubbles present in the line from the difference of the two signals. In this case there is no certainty of what is happening along the line. It would indeed be preferable, for an accurate measurement, to position several along the line (without denying that a single sensor is sufficient, though possibly less accurate). Where only one is positioned, it is advantageous (but not strictly necessary) to place it immediately before the dispensing means; in such a case, it is advisable to be stricter with respect to the amount of foam detected, since there might not be an exact monitoring of the state of the whole line.

The partialization means 22 is configured to introduce the gaseous substance into the container at a partialization pressure $P_{22}$. As already mentioned above, the gaseous substance introduced by the partialization means might also not be the same as the substance dissolved in the liquid. If, for example, the container is represented by a tank containing gas, the partialization means 22 can comprise a pressure reducer.

Optionally, the partialization means 22 can comprise a compressor, in which case the partialization pressure $P_{22}$ could be greater than the pressure in the tank prior to the activation of the compressor. The compressor can thus raise the pressure of the gas contained in the tank (before introducing it into the keg), or compress air taken from the environment and to be introduced into the keg. In other words, the partialization pressure is not necessarily a fraction smaller than one of the pressure in the tank.

The control means 72 is capable of receiving information from the means for indicating the presence of foam and sending setting commands to the partialization means 22. In particular, the control means is configured to determine a desired pressure $P_{10}$ (also called counter-reaction pressure) in the container on the basis of the indication of the presence of foam. In other words, the control means 72 acts in order to perform a counter-reaction: in the presence of foam in the line, the control means 72 determines a pressure in the container 10 which eliminates or is intended to eliminate the foam. Furthermore, the control means 72 determines a pressure set via the partialization means (or reducer in one example), such that this pressure brings the pressure in the container 10 to the one determined by the counter-reaction; in other words, the desired pressure is the one calculated by the controller on the basis of the presence (or absence) of foam, and is obtained by acting on the partialization means. The control means 72 thus dynamically determines, on the basis of the presence of foam in the line, a pressure of counter-reaction to the presence of foam, to be implemented in the keg as a function of time, and obtained in the keg by adjusting the partialization means. An example will be provided below to further clarify how the counter-reaction carried out by the control means 72 takes place.

Furthermore, the control means is configured to set the partialization pressure $P_{22}$ on the basis of at least one of the following parameters: the desired pressure in the container $P_{10}$, a dispensing status of the dispensing means 60 (i.e. closed or open, or non-zero or zero flow) and an indication of a variation in the presence of foam in the conduit. As evident also from the following description, the pressure $P_{22}$ can also be set on the basis of a combination of two or more of any of the parameters just described. Furthermore, the desired pressure that the control means 72 seeks to impose in the container can also advantageously be determined by measuring the temperature of the beverage in the keg, thus having the saturation pressure of the beverage at that temperature as the desired pressure.

By way of illustration, let us consider the following example case. A beverage container having a much lower temperature than that of the environment in which it is connected to the conduit reaches a thermal equilibrium with the environment in the space of a several hours. This could be, for example, the case of a container that is cold because transported in winter. Let us further suppose that the beverage is dispensed during the time necessary for the beverage to reach a thermal equilibrium. As a consequence of the low temperature, the pressure in the container (set by the system, for example via the partialization means) could be too low to avoid the formation of foam during dispensing (for example if the pressure in the keg was set based only on knowledge of the temperature in the keg); furthermore, this storage pressure will vary over time with the increase in temperature up to the ambient temperature. Furthermore, in the example, the beverage is periodically dispensed and foam is created along the conduit. The foam is detected by the means for indicating the presence of foam. However, as a consequence of the detection of foam, the pressure of gas introduced into the keg is varied (for example increased), so that the pressure in the keg likewise increases; this increase is allowed by the controller until foam is no longer detected in the line. The ideal (above also called desired) pressure under which to place the container is thus not a single value that can be predetermined, but is rather dynamically determined.

Furthermore, in one example, this pressure can dynamically depend also on the temperature of the beverage in the keg (and thus on the storage pressure), as well as the presence of foam in the conduit and the amount of dispensing operations and the moment at which they occur.

If a temperature measurement is not possible or not provided, the system can assume (or be configured on) a certain temperature, such as, for example, room temperature; the system would function in any case, though possibly with less precision than if the pressure were determined also on the basis of the temperature. In the example in which the means for indicating the presence of foam 32 is represented by a piston as discussed above, the device 92 can be configured to detect a presence of foam upon the occurrence of a number $N_f$ of "fails", where a fail is represented by a piston stroke in the direction of the liquid without the pressure in the conduit having reached a desired value. For example, if the pressure in the conduit has not reached a desired value following a cycle of five strokes, the calculation of a new pressure value $P_{10}$ in the container will not automatically imply that the reducer must be set to vary this pressure. As is evident, in fact, from examples discussed further below, the control algorithm can determine, according to circumstances, whether or not to activate the partialization means to apply the modified pressure so that the pressure in the container also varies. One of the advantages of the second embodiment resides in the fact that it is possible to impose the pressure in the keg, for example as a function of the temperature of the beverage contained therein and/or the carbonation characteristics thereof, and act upon the partializer, i.e. vary the amount of pressure to be maintained in the keg (only) on the basis of an indication of whether foam is present in the line or not, so as to impose in the keg the smallest possible difference between the saturation pressure of the beverage contained therein and the pressure which ensures operating stability, i.e. the absence of undesirable foam in the line during dispensing. In fact, as is well known, the presence of even a minimal amount of foam in the line renders dispensing unstable because a presence of even minimal foam causes a chain reaction increasing the same; an extreme case in which only foam comes out of the tap can also occur if the dispensing parameters are not changed.

In other words, the pressure in the keg is varied by means of the partializer to ensure that there is a pressure as close as possible to the saturation pressure in the container 10, because under such a condition the characteristics of the beverage (e.g. beer) will not be altered, but such as to avoid or at least reduce the formation of foam. In general, it is thus possible to prevent the presence or formation of foam, or at least to reduce it. As the person skilled in the art will recognize, the expression "as close as possible" means, in practice, that the pressure $P_{10}$ must be at a distance from the saturation pressure of the beverage at its current temperature, the distance being within a predetermined amount (additional to the saturation pressure). The predetermined amount serves, for example, to take into consideration experimental measurement errors, hysteresis, small non-significant fluctuations and tolerance of measuring instruments, unstable situations arising during a dispensing operation after a prolonged stop, as well as, naturally, to ensure that the partialization means is not continually activated for negligible pressure corrections. The predetermined amount can correspond, for example, to 5% of the pressure value, and preferably to 2% of the latter. As also explained further below, the desired pressure can be between the saturation pressure and the pressure corresponding to the mechanical curve; therefore, the predetermined amount can be such as to set the determined pressure at a value comprised within said interval. Obviously, the value of this pressure difference (the ideal one would be zero) will depend on the type of installation, the temperature, and/or the various operating conditions; in any case, the control means 72 will obtain the best possible solution for that particular system 92 at that particular moment. This means considerable savings in gas, whilst optimizing the beverage dispensing conditions, i.e. minimizing the formation of foam and the alterations that excessive pressure in the keg causes to the organoleptic characteristics of the beverage over time. It is noted, moreover, as discussed further below in several examples, setting the partialization pressure also comprises cases in which the pressure in the keg is maintained unchanged, for example according to other system operating parameters.

According to the above example, the control means is capable of receiving information from the means for indicating the presence of foam and sending setting commands to the partialization means 22. A case in which the control means sends setting commands to a compensation means 80 (such as the one discussed in other parts of the present description) instead of or in addition to the partialization means 22 is however also conceivable. In other words, if too much foam is detected, the flow rate can be reduced and thus the pressure in the line can be increased during dispensing by means of the compensator, as a replacement for or in addition to the partialization adjustment. Therefore, the above is also applicable to a compensation means, i.e. it is possible to apply the above by replacing the partialization means with the compensation means (or by applying the teaching to both).

Furthermore, with reference to the second embodiment (and the modifications thereof, also optional ones), it has been illustrated that the control means set the partialization pressure; however, according to an alternative not illustrated in the figures, the control means can be configured in such a way as to set the pressure of the pushing means, wherein the pushing means includes at least one between the partialization means (as thus far described) and a pump disposed downstream of the keg/container. In such a case, what has been described can be reached by varying the partialization pressure and/or the pushing pressure provided by a pump, in order to avoid or limit the formation of foam in the line.

Optionally, the desired pressure in the container $P_{10}$ is a value comprised between a saturation pressure value of the beverage and a maximum pressure value, wherein the saturation value of the beverage is the one corresponding to the saturation state of the gas in the liquid at a temperature inside the container, and the maximum pressure value is the one corresponding to a maximum preset value, preferably according to the temperature inside the container. For example, the maximum preset value can be a value belonging to a calibration curve decided on the basis of the average seasonal temperature and/or the characteristics of the beverage. The calibration curve can also be indicated with the term mechanical curve, to indicate that in the prior art systems calibration was performed, for example, for a given season of the year on the basis of the characteristics of the beverage. Therefore, the device 92 is capable of automatically varying the pressure inside the keg between the saturation curve and the mechanical curve, in a continuous and/or discrete manner, as also illustrated further below, on the basis of an indication of the presence of foam directly in the conduit.

Optionally, in the above-described device 92, the control means 72 is configured to determine a desired pressure $P_{10}$ in the container on the basis of the temperature of the beverage in the container, the type of beverage contained in the container and the indication of the presence of foam. In such a case, it is therefore possible to set the pressure in the keg, according to the presence of foam, so that for that type of beverage a given pressure is chosen which is above the saturation pressure corresponding to the temperature present in the keg. Therefore, optimal dispensing of the beverage can be achieved.

Optionally, in the device 92 discussed here, the control means is configured to set the partialization pressure on the basis of the desired pressure in the container $P_{10}$ and the indication of a variation in the presence of foam in the conduit. The desired pressure $P_{10}$ in the container is typically the minimum pressure necessary to fulfil a predetermined dispensing condition (see further above), since one wishes to use up as little gas as possible to dispense a given amount of beverage in a given period of time. The indication of the variation in the presence of foam in the conduit can be represented, in one example, by a set of values, for example comprised between "1" (indicating a value of foam that is absent or present in an acceptable amount) and a value "5" indicating an intolerable presence of foam. The controller 72 can be configured to maintain the pressure $P_{10}$ in the keg unchanged in the presence of an indication of 1 or 2, whereas the controller will allow a different pressure to be set in the keg by activating the reducer whenever the indication of the presence of foam has a value in the range of 3 to 5. The values are solely examples, as a person skilled in the art will immediately recognize.

Optionally, the indication of the presence of foam comprises an activation value activating a pressure variation system in the conduit, wherein the variation system is disposed along the conduit and configured to deliver at least some of a component liquid of the beverage into the conduit. In one example, this is represented by the piston with an upstream check valve, although the invention is not limited to this example, as also discussed above.

Optionally, the means for indicating the presence of foam 32 comprises a piston suitable for delivering some of a component liquid of said beverage into said conduit; in such a case, the means for indicating the presence of foam 32 is configured to generate an indication of the presence of foam when at an activation value of the piston it is not possible to reach a predetermined pressure $P_{40}$ in the conduit. Alternatively, the indication of the presence of foam can be associated with a given activation value of the piston, or with a plurality of activation values as also discussed above. Optionally, the activation value generated by the piston comprises a number of strokes carried out for each attempt to represent the pressure in the conduit, or for each operating cycle, wherein the cycle is made to start upon a command of the controller to vary the pressure in the conduit. The number of strokes carried out is not necessarily a whole number, but can be also a non-whole number (rational, i.e. a fraction). The attempt can also be defined as a time interval in which the piston is controlled so as to vary the pressure (e.g. by introducing liquid into the conduit), irrespective of the number of the strokes, or as a maximum number of strokes to be carried out for each activation command. For example, the attempt (or cycle) refers to a specific instance of control in which the piston, or in general the pressure variation system, is controlled so as to deliver liquids into the conduit, or in general to raise the pressure in the conduit in the case of different systems for managing the pressure in the conduit, in order to attempt a pressure increase in the conduit itself.

Optionally, the means for indicating the presence of foam 32 is further configured to generate an indication of a variation in the presence of foam in the conduit on the basis of a plurality of activation values of the piston, such values corresponding to different attempts to increase the pressure in the conduit. In fact, if the piston uses a number of strokes per cycle greater than a threshold, there will be an indication of a greater amount of foam than when in a single cycle the piston carries out a smaller number of strokes. Therefore, the number of piston strokes can be directly associated (but not necessarily) with an indication of the level of foam present in the conduit. Alternatively, the number of strokes can be made to correspond with the level of foam present in the conduit, subject to the presence of correction factors that may also be calculated empirically. Optionally, the control means 72 is configured to set the partialization pressure $P_{22}$ on the basis of the desired pressure in the container when the indication of a variation in foam is positive, irrespective of the status of the dispensing means. It is observed that a positive indication of a variation in foam indicates a tendency to have more foam in the line, and in the example of the piston it can be represented by a higher foam index or a high number of strokes per attempt. As will be illustrated further below in an example, a case of partialization of the pressure irrespective of the status of the dispensing means is also possible.

Optionally, setting the partialization pressure comprises: maintaining the partialization pressure when the indication of a variation in foam is negative or zero, when the dispensing means is in a dispensing status and when the pressure of the container falls below the desired pressure. As also illustrated further below in an example, when the piston indicates that there is no foam, or that the foam is negligible, gas will be introduced only during dispensing (i.e. when the dispensing means is open) and when the pressure falls below a preset value. The desired pressure refers to that of the keg and indicates a minimum pressure necessary to obtain a predetermined dispensing condition, as also discussed above, in order to minimize the use of gas.

Optionally, setting the partialization pressure comprises maintaining the partialization pressure $P_{22}$ unchanged when the indication of a variation in foam is negative or zero and the dispensing means is in a non-dispensing status. That is, the partialization pressure remains unchanged, and hence also the pressure in the keg, when it is established that the foam in the conduit is tolerable or is being reduced to tolerable levels at least when the beverage is not in a dispensing status. In this case if the currently set partialization pressure is greater than the desired one, the system will allow the pressure to fall (also during dispensing) until the desired pressure is reached in the keg or until the indication of zero or decreasing foam changes into excessive or increasing foam.

The second embodiment was described above with reference to the device 92. However, an alternative embodiment can also be described with reference to a method (FIG. 7) for controlling the device 92 for on-site dispensing of a beverage containing a liquid and a gaseous substance dissolved therein, wherein the device comprises a dispensing means 60 for dispensing the beverage. This method comprises a step S710 of supplying the beverage to the dispensing means 60 by means of a conduit 40, and a step S720 of providing an indication of the presence of foam in said conduit. Furthermore, in a step S730 the gaseous substance is introduced at a partialization pressure $P_{22}$ in a container 10 suitable for containing at least liquid necessary to obtain the beverage. In a step S740, a desired pressure in the container $P_{10}$ is determined on the basis of the indication of the presence of foam; in other words, a determination is made of which pressure may be most appropriate to set in the container on the basis of the indications of the presence of foam, for example with the aim of decreasing the presence of foam in the conduit. In step S750, the partialization pressure $P_{22}$ is set on the basis of at least one of the following parameters: the desired pressure in the container $P_{10}$, the dispensing status of the dispensing means 60, and an indication of a variation in the presence of foam in the conduit. The variation in the presence of foam in the conduit can be in turn determined on the basis of the indication of presence of the foam, and in particular how the latter evolves, or on the basis of an estimate of the possible evolution thereof.

Optionally, the step of setting the partialization pressure comprises setting the partialization pressure on the basis of the desired pressure in the container and an indication of a variation in the presence of foam in the conduit.

All the considerations set forth above with reference to the device according to second embodiment, as well as what was said with reference to the first embodiment and the variants thereof, apply for the method according to this alternative embodiment.

The second embodiment can alternatively be described or implemented in the form of a computer program (implemented for example in a generic electronic device) comprising instructions that are suitable for executing the steps of each of the methods and the variants thereof, also the optional ones described in the above embodiments, when the program is run on a computer.

Furthermore, the second embodiment can alternatively be described or implemented in the form of a computer-readable medium, wherein said medium contains instructions that are suitable for executing the steps of each of the methods and the variants thereof, also the optional ones described in the above embodiments, when the program is run on a computer.

For example, in the pressure control algorithm it is possible to shift between the desired and maximum pressures by moving in fixed, discrete steps. In the dichotomy method, instead of shifting between fixed points, the new pressure value is determined as the average point between the current pressure and the final one toward which we are moving. If the system is in P1 and the pressure needs to be increased, it goes to P1+(Pmax−P1)/2; if it has to be decreased, it goes to P1−(P1−Pmin)/2 . . . . The Newton-Raphson method is a different optimization method which is based on the derivatives of the function to be optimized in order to define the presumed optimal value.

In the prior art, the pressure present in the keg can be controlled, for example by adjusting the reducer; this is done on the basis of the temperature present in the keg. Such known solutions are not, however, effective in limiting or reducing the formation of foam, especially in systems with a very long beverage line. In fact, as gathered from observations, such techniques assume a perfect setting of parameters such as to prevent the formation of foam, and above all a perfect efficiency of the system for cooling the line, something that is not possible in practice. It follows that if foam is generated for any reason, e.g. a transitory phase in which the cooling system loses efficiency due to intensive use, the same known systems will not be capable of eliminating it without an outside intervention (they will not be capable of adapting the push to counter the foam). According to the present solution, by contrast, the presence of foam in the line is detected, and a desired pressure value is set in the keg accordingly on the basis of the whether or not foam is present in the line. The set pressure does not mean that the reducer will be immediately activated: in fact, the reducer is controlled also on the basis of other parameters, such as the increase and decrease in foam, or the dispensing status, or the state of the pressure in the keg relative to the set pressure, in order to obtain savings in gas simultaneously with a reduction or elimination of foam. In other words, it is possible to obtain the maximum potential of a system without there being any need for substantial modifications to the system itself, while reducing or eliminating the phenomenon of the formation of foam and saving on the content of gas.

The second embodiment can also be illustrated by means of this illustrative algorithm for controlling the pressure in the keg (with reference to beer, but similar considerations apply for other beverages):

Input Data
Tap status (open, closed)
Keg temperature
Type of Beer
No of oks/fails of the pump (algorithm illustrated with reference to the first embodiment)
Warning from the algorithm illustrated further below with reference to the third embodiment (yes/no)
Output Data/Commands
Pressure to be maintained in the keg/reducer Operation of the Algorithm B Once the temperature of the beer in the keg has been defined, the pressure to be set in the keg is calculated, moving between two values: Pmax, the pressure at which a traditional system would work; and Pmin, the saturation pressure for the specific beer at the temperature read.

Example: the curve of lager beer is practically a straight line which in the temperature-pressure Cartesian plane passes through the points

| ° C. | bar |
|---|---|
| 0.0 | 0.6 |
| 20.0 | 2.0 |
| 40.0 | 3.5 |

The Pmax−Pmin interval is divided into 5 points, which may or may not be equally spaced; here we shall assume that there are 5 pressure values defined by DP=(Pmax−Pmin)/4. The 5 pressure values are identified by an index that ranges from 1 (Pmin) to 5 (Pmax).

At the start of a new keg, the control is set on Pmin+DP, index 2. After each beer dispensed, opening and closing of the tap with flow, the above-described algorithm A sends an "ok" or a "fail" according to whether or not the pump succeeds in restoring the line pressure to the set value (4.5 bar). Every 3 consecutive "oks" (for three dispensing operations the pump succeeds in restoring pressure in the line in the first cycle) the set pressure value is reduced by DP and the index is reduced by one unit until reaching Pmin, index i=1. Every 5 consecutive "fails" the set pressure value is increased by DP until reaching Pmax, i=5. As may be inferred, the piston is a source of information on the presence of foam.

Every time the value of the index changes, the "oks" and "fails" are reset to 0; after every "fail", the "oks" are reset to zero and vice versa.

Therefore, in order to obtain a reduction in the index, 3 beers must be dispensed and the piston must succeed three times in restoring pressure in the first cycle (only liquid in the line); in order to obtain an increase in the index it is enough that, after a beer is dispensed, the pump does not succeed in restoring the pressure in the line over five consecutive cycles.

If a new beer temperature is detected in the keg, the values of Pmax and Pmin will change, but not the value of the index i.

Once the pressure to be set has been defined, the reducer is controlled as described below:

With the index i unchanged or varied downwards, the reducer will introduce pressure into the keg only when the tap is opened (dispensing step) and only when the pressure in the keg falls below the set value. If the system is not in the dispensing status (tap closed) the reducer will not intervene, irrespective of the pressure in the keg.

With the index i varied upwards, i.e. there is a need to raise the pressure due to incipient foam in the line, the reducer will immediately restore the new pressure in the keg as soon as the index varies, irrespective of the status of the tap. Once raised, the pressure value will go back to behaving as described above.

Clearly, the partialization means is controlled on the basis of one or more parameters, as also described previously.

The operation according to this embodiment and example can also be explained with reference to FIG. 16 illustrating a diagram in which the temperatures are plotted horizontally, and the pressures vertically. The curve $C_s$ represents the saturation curve of the beverage, for example of the beer like in the above example. The curve $C_L$ instead represents the limit curve, that is, the set of points representing a maximum acceptable pressure value as the temperature varies. The limit curve $C_L$ can be set on the basis of the maximum pressure at a given temperature at which the beverage still retains certain properties judged to be desirable for its enjoyment (e.g. at a pressure greater than the one indicated by the curve $C_L$, the beverage could lose certain organoleptic properties). This curve can also be determined empirically. Furthermore, the curve can be specific for a beverage, or for a type or family of beverages. As a first approximation, it is also possible to think of a default curve to be applied for all gas-containing beverages. Furthermore, this curve could be determined, besides on the basis of the desired properties of the beverage, by the operating conditions of the device, e.g. in such a way that the pressure on the curve $C_L$ never exceeds the maximum operating pressure of the system components. In the figure, the curve $C_L$ is a straight line, but it can be any function or curve (also represented in discrete form, e.g. by means of a table) that relates pressure and temperature. It is further noted that in classic mechanical systems, in which calibration is performed manually and infrequently, the limit curve is typically represented by the broken line $C_L'$. When the calibration is changed, the curve $C_L'$ will be lowered or raised. Going back to the example of FIG. 16, the interval between the saturation pressure and the maximum pressure on the curve CL is divided in the example into five intervals, with the consequent formation of five indices i=1, 2, . . . , 5. As starting conditions let us assume a temperature in the keg equal to $P_{10}'$, and a pressure in the conduit 40 such that the index read in that moment is for example i=4. In this situation, the index will be increased or decreased according to the embodiment explained above, see also the example of algorithm B. If, by contrast, the index falls to the value i=2, the device (for example by means of the controller) can bring about an increase in the pressure in the keg: therefore, first a pressure $P_{10}''$ greater than $P_{10}'$ is calculated, and then the reducer is controlled so as to enable an increased entry of gas into the keg in order to bring the pressure in the keg to the value $P_{10}''$. This new value will help to keep the beverage away from potential foam conditions; the index i could consequently vary as a result of the greater pressure in the keg. If the index i should increase, for example to 3 as a consequence of the increase in pressure in the keg, the system could calculate a new value $P_{10}'''$ (not illustrated, comprised between $P_{10}'$ and $P_{10}''$) to which to set the pressure in the keg. Clearly, through this combined action it is always possible to remain in safety, while minimizing the use of gas. The example has been explained with certain values of the index i, but what has been illustrated is clearly not limited to this example and indeed applies for any interval of values between 1 and N, in which there is one or more thresholds of non-intervention on the pressure of the keg depending on the value i. Or else the new pressure can be calculated by means of known optimization methods, such as, for example, the dichotomy or Newton-Raphson method.

With reference to FIG. 8, a third embodiment relating to a device 94 for on-site dispensing of a beverage containing a liquid and a gaseous substance dissolved therein will now be described. The same considerations set forth above also apply below, unless otherwise indicated. The device 94 comprises a dispensing means 60, a conduit 40, a pressure and/or flow compensating means 80, a measuring means (for example, for measuring pressure and/or temperature) 82 and a control means 74. The conduit is capable of supplying the beverage to the dispensing means 60 and comprises a connection means 11 for connecting the conduit 40 to a container 10 suitable for containing at least liquid for obtaining the beverage. The pressure compensating means 80 is disposed along the conduit 40 and configured to vary the flow rate of the beverage. A variation in the flow rate of the beverage corresponds to a respective inverse variation in the pressure upstream of the compensation means; this pressure is therefore also called compensation pressure, precisely because it is read at the compensation means (it shall be noted, even if superfluous, that in the present description we will often discuss situations in which liquids and gas coexist in the conduit as separate phases, as well as the situation in which the liquid in the conduit has gas dissolved in it, as a single phase therefore). In particular, an increase in the flow rate of the beverage corresponds to a decrease in the compensation pressure, and vice versa. It is further noted that the compensation means is preferably disposed at the end of the conduit 40 that is as close as possible to the dispensing means 60: in fact, downstream of the compensation means, during dispensing, the pressure of the beverage decreases considerably, with consequent risk of foam forming, the reason why it is more convenient and advantageous to position the compensation means in proximity to the tap.

The measuring means 82 is configured to generate a temperature measurement and a pressure measurement of the beverage at the pressure compensating means 80. "At" means that both the temperature and the pressure of the beverage are measured inside the compensator or in proximity thereto, preferably immediately before, preferably not after. The temperature measurement and the pressure measurement can represent the actual value measured by the respective sensors, or respective indices related to the measurements performed.

The control means 74 is configured to generate saturation information on the basis of a comparison between the pressure measurement and the saturation measurement of the beverage corresponding to the temperature measurement. In other words, based on the temperature measurement it is possible derive the saturation pressure of the beverage (e.g. if the beverage is known, or assuming an approximate value for the beverages dispensable from the device); once the saturation pressure has been calculated or determined, it is possible to obtain the saturation information, for example by subtracting the pressure measurement from the saturation pressure thus calculated. The saturation information thus represents to what degree the pressure of the beverage in proximity to the compensator deviates from the saturation pressure of the beverage itself in proximity to the compensator, and thus a measure of the possibility of gas being released from the liquid during dispensing with the consequent formation of foam. Considering that this point is the most critical, as here the beverage has the lowest pressure and the highest temperature in the entire conduit 40, these measurements give an indication of the state of safety of the entire line with respect to whether or not there is a possibility of incipient foam during dispensing.

The control means 74 is thus configured to determine a variation in the flow rate of the beverage on the basis of the saturation information when the dispensing means is in a dispensing status. The pressure compensating means 80 is thus configured to apply the variation in the flow rate determined or calculated by the control means 74.

In other words, on the basis of the saturation information indicating how far away the beverage is from the saturation conditions at any given instant during dispensing and in proximity to the compensator, the compensator will be controlled in such a way as to vary the flow rate of the beverage and bring it back to a situation of safety in order to avoid or reduce the formation of foam, obviously by moving between a desired nominal flow rate in the line and a minimum allowed flow rate. For example, if the pressure measured is less than or equal to the saturation value of the beverage (at the measured temperature), possibly, subject to the presence of a margin factor, and the flow rate is (optionally) greater than the acceptable minimum, the device will react by decreasing the beverage flow rate until it succeeds in restoring conditions of safety or reaches the minimum flow rate or the detected saturation conditions of the beverage during dispensing change. The decrease in the flow rate, as said, results in an increase in pressure in proximity to the compensator and hence also in the circuit upstream thereof. This increase in pressure (as a consequence of the decrease in the flow rate) brings the beverage to a sufficiently high pressure, distant from the saturation pressure, and thus such as to avoid or reduce the formation of foam. If the measured pressure should be considerably greater than the saturation pressure, for example greater than the saturation pressure with the addition of a second threshold margin, and the flow rate (optionally) less than the nominal flow rate, the device could react by increasing the flow rate in order to bring it back to the nominal value. The flow rate can thus be increased until the measured pressure remains equal to or above the saturation pressure plus the first safety threshold established to ensure that no foam is formed.

Optionally, based on what was said above, according to one example, determining a variation in the flow rate of the beverage comprises decreasing the flow rate of the beverage, thus obtaining an increase in the pressure of the beverage at the compensation means, e.g. if the saturation information indicates that the pressure measurement is less than or equal to the saturation pressure (at the measured temperature), subject to the presence of a lower threshold. The lower threshold can also take on a value equal to zero.

According to another example, determining a variation in the flow rate of the beverage comprises increasing the flow rate of the beverage, thus obtaining a decrease in the pressure of the beverage at the compensation means; this case is envisaged when the saturation information indicates that the pressure measurement is greater than or equal to the saturation pressure (at a measured temperature), subject to the presence of a higher threshold. The higher threshold is greater than or equal to the lower threshold.

Optionally, the control means 74 is configured to generate a warning signal if the saturation pressure information indicates that the pressure measurement is less than or equal to the saturation pressure, subject to the presence of a possible margin, and the flow rate applied is equal to the allowed minimum.

Optionally, the device 74 comprises a pushing means 20, 20' for imparting to the beverage a push sufficient to enable the dispensing of the beverage via the dispensing means 60 and according to a predetermined dispensing condition.

Optionally, the control means 74 of the device 94 is configured to cause the pushing means to increase the push if the saturation pressure information indicates that the pressure measurement is less than or equal to the saturation pressure, subject to the presence of a possible margin, and the applied flow rate is equal to the allowed minimum.

The second embodiment has been described with reference to a device. However, the solution can also be described according to an alternative embodiment relating to a method for on-site dispensing of a beverage containing a liquid and a gaseous substance dissolved therein. The device 92 to which the control method is applied comprises a dispensing means 60 for dispensing the beverage.

The method thus comprises a step S910 of supplying the beverage to the dispensing means 60 by means of a conduit 40, and a step S920 of generating a temperature measurement and a pressure measurement of the beverage at the pressure compensating means 80. Preferably, the pressure compensating means 80 is provided in proximity to the dispensing means, and is such that it can be activated so as to vary the flow rate of the beverage and thus, in an inversely proportionate manner, the pressure of the beverage at the compensation means.

In a step S930, a temperature measurement and a pressure measurement of the beverage are generated, wherein both the temperature and the pressure are the ones read at the compensation means 80. The measurement is preferably performed during dispensing, preferably continuously or at certain pre-established intervals of time, which may also be variable. In step S930, saturation information is generated on the basis of a comparison between the pressure measurement and a saturation pressure of the beverage corresponding to the temperature measurement. In other words, a saturation pressure is determined and calculated on the basis of the temperature measurement; by subtracting the former from the pressure measurement, possibly, subject to the presence of a corrective factor, saturation information is determined which indicates how far away the present state of the beverage is from saturation state thereof.

In step S940 a variation in the flow rate of the beverage is determined on the basis of the saturation information, in particular or preferably when the dispensing means is in a dispensing status. In fact, in the dispensing status, changes can occur in the pressure of the beverage, with the possible consequent formation of foam. In step S950, the variation in the flow rate determined in the preceding step S940 of determining a variation in the flow rate is applied by means of the pressure compensating means 80. The method can comprise other optional steps related to the above-described device or the operation of parts or optional features thereof. Furthermore, a second embodiment can also be described by a computer program, or a computer-readable medium containing instructions for running the computer program.

As explained at the beginning of the description, in known dispensing systems there can be a compensator to be calibrated manually, for example at a change of season or also daily in order to compensate for certain transitory circumstances. The present invention is based, in addition to other considerations, on the recognition that it is possible to implement an automatic control on the compensator on the basis of the temperature and pressure conditions of the liquid in proximity to the compensator itself. In particular, it has been recognized that by varying the flow rate of the compensator it is possible to inversely vary the pressure along the whole line, thereby avoiding the formation of foam. For example, if it should happen that the measured pressure is lower than the saturation pressure (or lower than the saturation pressure plus a lower margin), the compensator will reduce the flow rate and thus generate an increase in pressure in the whole line, thereby allowing the formation of foam to be avoided or reduced. It is noted that such activation can result in a lengthening of dispensing times; though is typically not desirable, it has been found that the benefit deriving from the possible reduction of the formation of foam justifies a possible lengthening of dispensing times. Furthermore, with such a control, in a regularly operating system, only the first beer is dispensed in a particularly slowed manner, as the subsequent ones arrive at the tap with lower temperatures.

If, on the other hand, the pressure in proximity to the compensator becomes equal to or greater than a value corresponding to the saturation pressure with the addition of an upper margin, the compensator can increase the flow rate, thus bringing the dispensing times back to shorter times. Furthermore, if the compensator closes to such an extent as to reach a minimum pre-configured flow rate, a warning signal can be generated, as a consequence of which the device can cause a rise in the pressure of the keg, for example by increasing the opening of the reducer as discussed in other embodiments. As is evident to the person skilled in the art, any type of pressure compensator is suitable for use (both in this and in the other embodiments). For example: a compensator with a conical shape or a trapezoidal cross section, driven by an electric motor (for example, but not necessarily, a stepper motor). A compensation means is in general represented by any other electrically drivable means capable of varying the flow rate of the fluid passing through it, for example by introducing a variation to the opening formed as a consequence of the relative movement of two parts/surfaces of the compensator through which the fluid flows, or also by means of a solenoid valve whose opening is modulated by a suitable electric signal (e.g. modulated according to PWM, etc.).

The third embodiment can also be illustrated by means of this illustrative algorithm for adjusting the beer flow rate coming out of the tap (with reference to beer, but similar considerations apply for other beverages):

Input Data
Tap status (open, closed)
Compensator inlet P.[bar] with the tap open
Compensator inlet T. [° C.] with the tap open
Minimum and maximum allowed flow rate
Output Data/Commands
Beer flow rate, warning (yes, no)/compensator
Operation of the Algorithm C Algorithm C is preferably activated with the tap open, when a flow of beer is detected. Under this condition, it measures the beer pressure and temperature at the compensator inlet and continuously verifies that the pressure is greater than or equal to the saturation value of the beer at the measured temperature. If it is not, it will reduce the flow rate until it returns to safety or to the saturation values. If, once the minimum allowed flow rate in the system is reached, the pressure is still lower than the saturation value, the algorithm will send a positive warning signal to the control means, which will immediately increase the value of the pressure index set in the keg by one unit.

Once the flow has been reduced, completely or also partially, the algorithm will assess, upon each pressure and/or temperature variation at the compensator, if it can return toward the maximum allowed flow rate.

Therefore, this algorithm can work in parallel with algorithm B and interacts therewith in the extreme case of critical conditions for foam at the imposed minimum flow.

As soon as the tap is detected to be closed, the algorithm is deactivated.

With reference to FIG. 10, the fourth embodiment relating to a device 96 for on-site dispensing of a beverage containing a liquid and a gaseous substance dissolved therein will now be described. Unless indicated otherwise, what was said above in relation to the other embodiments also applies to the present one. The device 96 comprises a dispensing means 60, a pressure compensating means 86, a measuring means (for example for measuring pressure and/or temperature) 88 and a control means 76. The dispensing means 60 is configured to dispense the beverage supplied to the dispensing means 60 by means of a conduit 40. The conduit is configured to be connected, or is connectable, to a container suitable for containing the beverage itself or at least liquid necessary to form the beverage; see also above. The pressure compensating means 86 is disposed along the conduit 40, preferably in proximity or directly connected to the dispensing means 60, and is configured to set a partialization of the beverage flow rate so as to obtain a corresponding compensation pressure indicated as $P_{82}$. The compensation pressure P82 can be considered, to a good approximation, the same at the compensator inlet and outlet at zero flow. For further details on the compensation means, reference may be made to what was illustrated above.

The measuring means 88 is configured to generate a temperature measurement of the beverage at the pressure compensating means 86.

The control means is configured to control the pressure compensating means so that the latter sets a flow rate partialization equal to a pre-partialization value determined on the basis of the temperature measurement, when the dispensing means is in a non-dispensing status. In particular, the control means 76 can send the command at any time, for example if it is calculated again, continuously or repeatedly (e.g. in real time, or after a delay); however, the pre-partialization is actually applied to the compensation means only in the presence of a non-dispensing status. For example, if the controller sends a pre-partialization value during dispensing of the beverage, the compensator will not apply the pre-partialization until the dispensing of the beverage is completed. In another example, the controller will send the pre-partialization value only after having verified that no beverage dispensing is in progress. Pre-partialization means a pre-closure of the compensation means relative to the state of maximum opening or the maximum configurable flow rate. Therefore, pre-partialization means setting the compensator in such a way that the flow rate corresponding to the pre-partialization is lower than the maximum flow rate allowed by the compensator. In known systems, taps can be activated to open or close also under electronic activation, or, as seen above, they can be modified so as to vary the flow rate during dispensing, i.e. after the opening of the tap. It has been observed, however, that even if the compensator is automatically controlled during dispensing, the formation of foam can occur, for example due to a delay in the times at which the compensator is automatically activated. It is therefore observed that the formation of foam can be decreased or even avoided by ensuring that, when the tap is opened, the compensator is already set on a limited flow rate value. In particular, according to the temperature of the beverage in proximity to or inside the compensation means, it is possible to determine a pre-closure of the compensator such as to generate a flow rate, or a corresponding compensation pressure (remembering that an increase in the flow rate corresponds to a decrease in the compensation pressure and vice versa) so that the resulting compensation pressure is sufficiently higher than the saturation pressure. This therefore enables the formation of foam to be avoided or at least prevented. If the compensator is automatically controlled as described above, for example, with reference to the third embodiment, it is preferable to maintain the pre-partialization setting for a given transient time Tt, said time interval being determined on the basis of the response times of the automatic control system. In other words, the pre-partialization is maintained from the moment in which it is set and when the tap is open for a time interval which elapses between the opening of the tap and the time when a possible automatic control algorithm begins to produce its effects. In other words, the present recognition makes it possible to act in a preventive manner once the temperature measurement at the tap is known. This can be also combined with other parameters, such as, for example, the pressure of the keg. Given that when the flow is stopped the pressure of the keg determines the pressure in the point where the temperature is measured, it is possible to have information related to the state of saturation. What is more, the push in the keg for a given position of the compensator determines what the flow rate will be with the tap open, and hence what the pressure will be before the compensator; it is thus possible to know prior to opening whether with that position of the compensator at the temperature that is being read at zero flow critical conditions will occur as soon as the tap is opened, and thus apply, as said above, a preventive pre-partialization. As a further illustration of what was described above, it is noted, in fact, that opening the tap in general causes a pressure drop; when the pressure prior to opening is close to the saturation pressure, there is a risk that the pressure drop will cause the beverage to go below the saturation curve, thus generating foam. By pre-setting the closure of the compensator, however, it is possible to prevent this effect. Furthermore, by preferably measuring the temperature along the conduit when the tap is closed, together with other parameters such as the set flow rate and the pressure in the keg, one can predict the occurrence of critical states at the time of opening, and thus prevent such critical states by preventively reducing the flow prior to opening.

Optionally, the pre-partialization value is directly proportional to the temperature measurement, or in a biunivocal correspondence with the latter based on a curve or a generic table for a certain type of beverage or a specific one for the beverage to be dispensed. In this manner, it is possible to set, by means of the pre-partialization, a pressure in proximity to the compensator and in the conduit on the basis of the saturation pressure corresponding to the measured temperature.

Optionally, the control means 74 is configured to decrease the pre-partialization value when the dispensing means switches into a dispensing status. The dispensing can be progressive or drastic (i.e. all at once). In this manner, the effect of the pre-partialization disappears and the compensator flow rate becomes the nominal flow rate, possibly subject to variations if the compensator is automatically controlled. It shall be noted, even if superfluous, that the invention also works if the compensator is not subjected to other automatic controls apart from the one leading to the pre-partialization.

The fourth embodiment has been explained above with reference to a device. The same can also be explained, however, with reference to a method for controlling a device 96 for on-site dispensing of a beverage containing a liquid and a gaseous substance dissolved therein, wherein the device 96 comprises a dispensing means 60 for dispensing the beverage. The method thus comprises a step S1110 of supplying the beverage to the dispensing means 60 by means of a conduit 40 and a step S1120 of generating a temperature measurement of the beverage at the pressure compensating means 86. In a step S1130, the pressure compensating means 86 is controlled (for example by an appropriate control means) so as to set a flow rate partialization equal to a pre-partialization value determined on the basis of the temperature measurement, when the dispensing means 60 is in a non-dispensing status. The flow rate pre-partialization results in a variation in the compensation pressure in proximity to the pressure compensating means 86. That is, as discussed above in reference to other embodiments, a variation in the flow rate results in an inverse variation in the pressure at the compensator.

The fourth embodiment can also be illustrated with reference to a computer program comprising instructions that are suitable for executing the steps of the method described above, or of the variants or optional and accessory steps thereof—as also deducible from the explanation related to the device—when the program is run on a computer.

Furthermore, the present embodiment can also be illustrated with reference to a system for on-site dispensing of a beverage containing a liquid and a gaseous substance dissolved therein, wherein the system comprises a container 10 suitable for containing said beverage and a device 96 as described above.

The fourth embodiment can also be illustrated by means of this illustrative algorithm for adjusting the position of the compensator with the tap closed (with reference to beer, but similar considerations apply for other beverages):

Input Data

Tap status (open, closed)

Compensator inlet T. [° C.] with the tap closed

Output Data/Commands

Reduction in the beer flow rate/compensator

Operation of the Algorithm D

Algorithm D is activated with the tap closed and deactivated with the tap open, when a flow of beer is detected. With the tap closed, it continuously checks the beer temperature at the compensator inlet, and with increases in temperature it sets a progressive preventive reduction in flow (pre-closure of compensator) beyond given thresholds.

Example: for a T below 5° C., no reduction; beyond 5° C. there is a reduction in the flow rate of 0.5 litres/minute every 5° C. Therefore, if at 3° C. we have 2.5 litres/minute, at 7° C. we will have 2.0 l/min., at 11° C. 1.5 . . . .

Vice versa for decreasing temperatures.

FIG. 12 illustrates an example of a device in which the various embodiments can be implemented individually or in a combination of two or more of the same. In particular, there is a controller 9 which exemplifies the control means described above, and which contains a processor and a memory for carrying out one or more of the controls presented above. The unit 10 schematically represents the pressure varying means, exemplified, for example, by a piston, which communicates with the controller 9 in order to exchange information and commands. The reducer 3 is likewise in communication with the controller, by which it is activated as described above. The cylinder 2 containing gas under pressure is an example of the pushing means (although pushing means could also be understood as the tank and the reducer together). The compensator ⅞, too, is in communication with the controller, in order to carry out a compensation of the pressure and/or a pre-partialization as illustrated above. Furthermore, other components are illustrated for the sake of completeness.

FIG. 13 is a block diagram of a computer 1300 comprising: a memory 1330 for memorizing instructions necessary for executing one or more of the algorithms described above, sequentially and/or in parallel; a processor 1320 for executing the program instructions; an interface 1310 for communicating with other system components, such as, for example, the compensator, the pressure varying means (piston), and/or the reducer.

FIG. 14 shows an overall view of the constructive details of the system according to one example. FIG. 15A shows an enlarged view of a piston to be inserted in the conduit between the keg and tap; FIG. 15B shows an enlarged view of a reducer disposed between the gas tank and beverage container; FIG. 15C shows an enlarged view of a conical compensator driven by a stepper motor preferably disposed in proximity to the tap.

The above embodiments have been described, for example, in terms of devices. However, the same can be described in terms of method, computer, system and computer-readable medium. Therefore, any consideration set forth in relation to a device should be understood as valid for the respective method, computer, system and computer-readable medium (and vice versa).

Furthermore, reference has been made to terms such as pressure modulating means; it should be understood that nothing changes using a term such as pressure modulator, or piston, or piston unit, or pressure modulating unit. The same applies for the dispensing means (dispenser or tap), pushing means (pusher), control means (controller and processor), indicating means (indicator or indicator unit), partialization means (partializer), compensation means (compensator), and measuring means (measurer). Furthermore, in the above description, a device has been illustrated which can be made as a separate unit or comprised in an apparatus comprising additional units. It is further noted that the embodiments and/or a part thereof, and/or the examples and/or parts thereof disclosed above can be combined in a different manner, even if not explicitly described, as is evident to the person skilled in the art, who will recognise that the various aspects and/or components of each embodiment and/or example are combinable with other parts of the present description.

Naturally, the description set forth hereinabove concerning embodiments and examples that apply the principles recognized by the inventors is provided solely by way of example of these principles and therefore it should not be understood as a limitation of the scope of the invention claimed herein.

The invention claimed is:

1. A device for on-site dispensing of a beverage containing a liquid and a gaseous substance dissolved therein, the device comprising:

a dispensing means configured to dispense the beverage;

a conduit configured to supply the beverage to said dispensing means, wherein said conduit is configured to be connected to a container suitable for containing at least a liquid;

a pushing means configured to impart to said beverage a push sufficient to dispense the beverage via said dispensing means according to a predetermined dispensing condition;

a pressure modulating means suitable for modulating a pressure of the beverage in said conduit, wherein said pressure modulating means is configured to modulate the pressure of the beverage, including when a flow of the beverage is zero due to an effect of the dispensing means;

a control means configured to activate the pressure modulating means such that the pressure modulating means modulates a pressure in said conduit upon an occurrence of a predetermined condition; and a check valve disposed upstream of the pressure modulating means and a check valve downstream of the container.

2. The device according to claim 1, wherein the occurrence of the predetermined condition comprises an occurrence of at least one between:

a pressure value detected by a pressure sensor disposed along the conduit becoming equal to or less than a predetermined value; and said pressure modulating means reaching a maximum pre-established activation value.

3. The device according to claim 1, wherein the pressure modulating means is configured to force at least a portion of a liquid component of said beverage into said conduit.

4. The device according to claim 1, wherein the pressure modulating means is configured to decrease the pressure of the beverage in the conduit.

5. The device according to claim 1, wherein the pushing means comprises at least one between:

an introduction means configured to introduce said gaseous substance into said container at the pressure of the beverage in said conduit to provide said push, and a pumping means, disposed downstream of the container, configured to pump said liquid.

6. The device according to claim 1, wherein said pressure modulating means is configured to adjust the pressure of the beverage in said conduit between a plurality of non-zero values, including when the flow of the beverage is zero.

7. The device according to claim 1, wherein the control means is configured to activate said modulating means when the dispensing means is not dispensing the beverage.

8. The device according to claim 1, wherein the occurrence of a predetermined condition further comprises detecting when the modulating means is not capable of increasing the pressure up to a predetermined value, and upon the occurrence of the predetermined condition, the control means is configured to control the pushing means to cause an increase in a pushing pressure.

9. The device of claim 1, further comprising a container configured to contain said beverage.

10. A device for on-site dispensing of a beverage containing a liquid and a gaseous substance dissolved therein, the device comprising:

a dispensing means configured to dispense the beverage;

a conduit configured to supply the beverage to said dispensing means, wherein said conduit is configured to be connected to a container suitable for containing at least a liquid;

a pushing means configured to impart to said beverage a push sufficient to dispense the beverage via said dispensing means according to a predetermined dispensing condition;

a pressure modulating means suitable for modulating a pressure of the beverage in said conduit, wherein said pressure modulating means is configured to modulate the pressure of the beverage, including when a flow of the beverage is zero due to an effect of the dispensing means; and a control means configured to activate the pressure modulating means such that the pressure modulating means modulates a pressure in said conduit upon an occurrence of a predetermined condition, wherein the modulating means comprises a piston suitable for delivering at least some of a component liquid of said beverage into said conduit, said piston thus allowing the pressure of the beverage in said conduit to be adjusted.

11. The device according to claim 10, wherein the occurrence of the predetermined condition comprises an occurrence of at least one between:

a pressure value detected by a pressure sensor disposed along the conduit becoming equal to or less than a predetermined value; and said pressure modulating means reaching a maximum pre-established activation value.

12. The device according to claim 10, wherein the pressure modulating means is configured to force at least a portion of a liquid component of said beverage into said conduit.

13. The device according to claim 10, wherein the pressure modulating means is configured to decrease the pressure of the beverage in the conduit.

14. The device according to claim 10, wherein the pushing means comprises at least one between:

an introduction means configured to introduce said gaseous substance into said container at the pressure of the beverage in said conduit to provide said push, and a pumping means, disposed downstream of the container, configured to pump said liquid.

15. The device according to claim 10, wherein said pressure modulating means is configured to adjust the pressure of the beverage in said conduit between a plurality of non-zero values, including when the flow of the beverage is zero.

16. The device according to claim 10, wherein the control means is configured to activate said modulating means when the dispensing means is not dispensing the beverage.

17. The device according to claim 10, wherein the occurrence of a predetermined condition further comprises detecting when the modulating means is not capable of increasing the pressure up to a predetermined value, and upon the occurrence of the predetermined condition, the control means is configured to control the pushing means to cause an increase in a pushing pressure.

18. The device of claim 10, wherein the container is configured to contain said liquid.

19. A method for controlling a device for on-site dispensing of a beverage containing a liquid and a gaseous substance dissolved therein, said device comprising a dispensing means for dispensing the beverage, the method comprising:

supplying the beverage to said dispensing means by means of a conduit;

causing a push to be imparted to said beverage, said push being sufficient to enable the dispensing of the beverage via said dispensing means according to a predetermined dispensing condition;

modulating a pressure in said conduit upon an occurrence of at least a predetermined condition, wherein modulating the pressure in said conduit comprises activating a piston, said piston being configured to deliver a portion of a component liquid of said beverage into said conduit, said piston being configured to modulate the pressure of the beverage in said conduit.

20. The method according to claim 19, wherein modulating the pressure in said conduit comprises forcing at least the portion of the component liquid of said beverage into said conduit.

21. The method of claim 19, further comprising executing the method via a computer program comprising suitable instructions to run the program on a computer.

22. A device for on-site dispensing of a beverage containing a liquid and a gaseous substance dissolved therein, the device comprising:

a dispensing means configured to dispense the beverage;

a conduit configured to supply the beverage to said dispensing means, wherein said conduit comprises a connection means configured to connect the conduit to a container configured to contain at least a liquid;

a means for indicating a presence of foam in said conduit;

a partialization means configured to introduce said gaseous substance into the container at a partialization pressure;

a control means configured to determine a desired pressure in the container based on an indication of the presence of foam from the means for indicating the presence of foam, wherein the control means is configured to set the partialization pressure based on at least one among the desired pressure in the container, a dispensing status of the dispensing means, and an indication of a variation in the presence of foam in the conduit.

23. The device according to claim 22, wherein the control means is configured to determine a desired pressure in the container based on at least one of: a temperature of the beverage in the container and said indication of the presence of foam.

24. The device according to claim 22, wherein the control means configured to set the partialization pressure based on at least one among the desired pressure in the container, a dispensing status of the dispensing means, and the indication of the variation in the presence of foam in the conduit comprises the control means configured to set the partialization pressure based on the desired pressure in the container and an indication of a variation in the presence of foam in the conduit.

25. The device according to claim 22, wherein the means for indicating the presence of foam comprises a piston configured to deliver at least a portion of a component liquid of said beverage into said conduit, and wherein the means for indicating the presence of foam is configured to generate the indication of the presence of foam in said conduit when the piston fails to deliver said beverage into said conduit at a predetermined pressure in the conduit.

* * * * *